US008371885B2

(12) United States Patent
Yazaki et al.

(10) Patent No.: US 8,371,885 B2
(45) Date of Patent: Feb. 12, 2013

(54) OUTBOARD MOTOR

(75) Inventors: Makoto Yazaki, Saitama (JP); Shinichi Ide, Saitama (JP); Shigekazu Sakata, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 605 days.

(21) Appl. No.: 12/626,146

(22) Filed: Nov. 25, 2009

(65) Prior Publication Data

US 2010/0147257 A1 Jun. 17, 2010

(30) Foreign Application Priority Data

Dec. 12, 2008 (JP) ..... 2008-317691
Dec. 12, 2008 (JP) ..... 2008-317692
Dec. 12, 2008 (JP) ..... 2008-317693
Dec. 12, 2008 (JP) ..... 2008-317697

(51) Int. Cl.
*B63J 2/00* (2006.01)

(52) U.S. Cl. ..... 440/76; 440/77; 440/88 A

(58) Field of Classification Search ..... 440/77, 440/88 A; 123/195 C, 195 P; 454/78
See application file for complete search history.

(56) References Cited

U.S. PATENT DOCUMENTS 3,610,198 A * 10/1971 Alexandrowicz ..... 440/77
5,340,343 A 8/1994 Kawamukai et al.
6,579,135 B2 6/2003 Nemoto et al.
7,238,069 B2 7/2007 Ito et al.
2002/0111084 A1 8/2002 Nemoto et al.
2006/0116035 A1 6/2006 Ito et al.

FOREIGN PATENT DOCUMENTS

JP 61-220999 A 10/1986
JP 05-286490 A 11/1993
JP 09-125979 A 5/1997
JP 10-007087 A 1/1998
JP 2000-016389 A 1/2000
JP 2001-260985 A 9/2001

(Continued)

OTHER PUBLICATIONS

Japanese Office Action dated Mar. 8, 2011, issued in corresponding Japanese Patent Application No. 2008-317692.

(Continued)

*Primary Examiner* — Edwin Swinehart
(74) *Attorney, Agent, or Firm* — Westerman, Hattori, Daniels & Adrian, LLP

(57) ABSTRACT

An outboard motor has an internal combustion engine, an engine cover forming an engine compartment for holding the internal combustion engine therein, and a top cover covering the engine cover from above and provided with a carrying grip. An intermediate member is placed in a space between the engine cover and the top cover. First connecting parts for connecting the engine cover and the intermediate member are arranged in a space between the engine cover and the intermediate member, and second connecting parts for connecting the top cover and the intermediate cover are arranged in a space between the top cover and the intermediate cover. The connecting parts arranged in the spaces between the engine cover and the top cover ensure rigid connection, the degree of freedom of arranging the connecting parts is increased, and the engine cover can be manufactured at low cost.

14 Claims, 19 Drawing Sheets

FOREIGN PATENT DOCUMENTS

| | | | |
|---|---|---|---|
| JP | 2002-031002 | A | 1/2002 |
| JP | 2002-235621 | A | 8/2002 |
| JP | 2002-240785 | A | 8/2002 |
| JP | 2004-239156 | A | 8/2004 |
| JP | 2006-151242 | A | 6/2006 |
| JP | 2007-038989 | A | 2/2007 |
| JP | 2007-331665 | A | 12/2007 |

OTHER PUBLICATIONS

Japanese Office Action dated Mar. 29, 2011, issued in corresponding Japanese Patent Application No. 2008-317697.

Japanese Office Action dated Apr. 26, 2011, issued in corresponding Japanese Patent Application No. 2008-317691.

* cited by examiner

OUTBOARD MOTOR

BACKGROUND OF THE INVENTION

1. Field of the Invention

The present invention relates to an outboard motor including an engine, an engine cover forming an engine compartment for holding the engine therein, a top cover covering the engine cover from above, a ventilation system for ventilating the engine compartment, and so on.

2. Description of the Related Art

A known outboard motor disclosed in, for example, JP 2002-240785A includes an internal combustion engine, an engine cover forming an engine compartment for holding the internal combustion engine therein, and a top cover covering the engine cover from above, joined to the engine cover and provided with a carrying grip.

The carrying grip formed in the top cover of the outboard motor is gripped when the top cover and the engine cover are handled together for mounting and dismounting. Therefore, connecting parts for connecting the top cover and the engine cover are protrusions formed on the top cover or the engine cover and having a necessary rigidity.

When the connecting parts are formed on the small top cover of small size near its periphery where the thickness of the space between the top cover and the engine cover is small, the connecting parts are of low height, so that a necessary rigidity can be ensured for the connecting parts, and a necessary rigidity can be ensured for the top cover.

A space defined by the engine cover and the top cover is used as an air passage, such as an intake passage through which intake combustion air flows or a ventilation passage through which ventilation air for ventilating the engine compartment flows. The air passage has an air inlet through which air is taken in. The air inlet is formed in a duct extending upward in the air passage to suppress water flow such as sea water spray or rainwater drops, through the air inlet into the air passage.

In some cases, connecting parts need to be formed in parts of the top cover which are spaced widely apart from the engine cover when the top cover is of so large a size as to cover all or a major part of the top wall of the engine cover from above.

Connecting parts formed in such parts of the top cover spaced widely apart from the engine cover are inevitably high and have a low rigidity. Therefore, there is a limit to the distance between the engine cover and the parts in which the connecting parts are formed. If the height of the engine cover is increased to reduce the thickness of the space between the engine cover and the top cover from the viewpoint of ensuring a necessary rigidity for the connecting parts, a large mold is required for manufacturing the engine cover and hence the manufacturing cost increases. When the duct having the air inlet is formed in the engine cover, the manufacturing cost increases because the engine cover has a complicated shape.

Further, it is desirable that the space between the engine cover and the top cover imposes less restrictions on the arrangement of the connecting parts to enhance the rigidity of the engine cover and the top cover or to distribute a load placed through the top cover on the engine cover when the engine cover and the top cover are mounted and dismounted together by holding the top cover by the carrying grip.

Water is liable to flow into intake air for combustion when the intake air flows from the air-intake space defined by the engine cover and the top cover through an intake system into the combustion chambers of the internal combustion engine. A known outboard motor disclosed in, for example, JP 2006-151242A is provided with a baffle for preventing water from flowing into the combustion chambers.

When an intake system disposed in an engine compartment of an outboard motor opens into an air-intake space extending outside the engine compartment, the temperature of intake air that flows from the air-intake space into the intake system is lower than that of intake air that flows from the engine compartment into the intake system after the same has been heated in the engine compartment by heat radiated from the internal combustion engine. Such intake air of low temperature enhances the volumetric efficiency and output performance of the internal combustion engine.

However, since the intake system opens into the air-intake space extending outside the engine compartment, intake pulsation caused by the internal combustion engine is transmitted through the intake system to the air-intake space. Since the air-intake space is defined by the top cover and the engine cover, the engine cover is vibrated by the intake pulsation transmitted to the air-intake space to generate noise.

Known outboard motors disclosed in, for example, JP 5-286490A and JP 2007-38989A include a ventilation system forming a discharge passage through which air in an engine compartment is discharged to the outside and which are provided with an intake passage having an air inlet opening into a space outside the engine compartment.

In an internal combustion engine provided with an intake system having an intake passage forming structure which forms an intake passage having an air inlet opening outside an engine compartment and which is disposed in an engine compartment, air outside the engine compartment (hereinafter referred to as "outside air"), namely, intake air, flows directly into the intake passage. Therefore, the temperature of intake air that flows directly into the intake passage is lower than that of intake air that flows from the engine compartment into the intake passage after the same has been heated in the engine compartment by heat radiated from the internal combustion engine. Such intake air of low temperature enhances the volumetric efficiency of the internal combustion engine.

When a ventilation system is disposed in the engine compartment, the temperature of air flowing from the engine compartment to the outside of the engine compartment through a discharge passage is comparatively high. It is desirable to avoid heating of intake air for combustion by the air flowing through the discharge passage from a viewpoint of preventing the volumetric efficiency from being reduced.

If the discharge passage forming structure forming the discharge passage having an air inlet opening in the engine compartment and a ventilation outlet opening outside the engine compartment is disposed in a combustion air intake space extending outside the engine compartment, it is possible that intake air is heated by the heat of air flowing through the discharge passage through the discharge passage forming structure, thus causing reduction of volumetric efficiency.

In a power unit including an intake passage forming structure disposed in an engine compartment, it is desirable for the enhancement of volumetric efficiency to avoid exposing the intake passage forming structure to the high-temperature air in the engine compartment to the utmost by preferentially discharging air of a comparatively high temperature in the air in the engine compartment. A ventilation system needs to cool the engine body and engine accessories attached to the engine body, such as a generator, by ventilation air taken in from a space outside the engine compartment. When the discharge passage of the ventilation system and the intake passage of the intake system are formed in the engine compartment, it is desirable to suppress heating of air in the intake passage by the heat of the air flowing through the discharge passage.

A known outboard motor, having an engine cover forming an engine compartment for holding an internal combustion engine therein, disclosed in, for example, JP 4-166496A includes first and second air passage forming structures which form an air passage extending between a space outside the engine compartment and a space in the engine compartment and which are joined together with a sealing member held therebetween.

The sealing member made of rubber is exposed to the air passage and is compressed between the first and second air passage forming structures. The sealing member needs to have a rigidity to resist deformation that may be caused by pressure exerted thereon by the air flowing through the air passage.

If, while the sealing member has such a rigidity, a strong force is required for holding the sealing member in a predetermined shape between the first and second air passage forming structures when the first and second air passage forming structures are connected together during the assembly of the outboard motor and, consequently, the efficiency of work is lowered for connecting the first and second air passage forming structures.

When at least either of the first and second air passage forming structures is a part of a cover and the cover is used for connecting the first and second air passage forming structures with the sealing member held therebetween, the efficiency of work for connecting the first and second air passage forming structures is lowered still further.

SUMMARY OF THE INVENTION

The present invention has been made in view of the foregoing problems and it is therefore a principal object of the present invention to provide an outboard motor capable of facilitating formation of sufficiently rigid connecting parts between an engine cover and a top cover, of increasing the degree of freedom of arranging the connecting parts, and of making possible the manufacture of the engine cover at reduced cost.

Another object of the present invention is to simplify the shape of an engine cover to reduce the manufacturing cost by providing an intermediate member placed in a space between an engine cover and a top cover with a duct so as to project upward, to enhance the volumetric efficiency of an internal combustion engine by forming an intake silencing chamber by the intermediate member placed in the space between the engine cover and the top cover and to improve the cooling effect of ventilation air by forming an air passage through which ventilation air flows by the intermediate member placed in the space between the engine cover and the top cover.

A further object of the present invention to reduce noise generated by vibration of an engine cover caused by intake pulsation transmitted from an intake system in an engine compartment formed by an engine cover to an air-intake space, and to improve the effect of preventing entrance of water into the intake system.

A still further object of the present invention is to improve volumetric efficiency, intake efficiency and the effect of ventilation air on cooling an internal combustion engine through suppression of heat exchange between intake air flowing through an air passage and air flowing through a discharge passage by separately disposing an air passage forming structure forming the air passage and a discharge passage forming structure forming the discharge passage in an engine compartment and to facilitate attaching a transmission cover formed by parts of the air passage forming structure and the discharge passage forming structure to the engine body to cover a transmission mechanism for rotationally driving a camshaft included in the valve train of the internal combustion engine.

An additional object of the present invention is to ensure proper sealing of the joint of first and second passage forming structures connected together so as to form a connecting passage extending between a space outside an engine compartment of an outboard motor and a space inside the engine compartment, to facilitate work for connecting the first and second passage forming structures, to enhance the sealing effect of a sealing member held between the first and second passage forming structures by the pressure of air flowing through the connecting passage, to enhance the sealing effect of the sealing member by the pressure of intake air flowing through the connecting passage into the internal combustion engine, to enhance the sealing effect of the sealing member by the pressure of ventilation air discharged from the engine compartment and flowing through the connecting passage to facilitate work for connecting the first and second passage forming structures and to facilitate forming a flexible part of the sealing member by properly designing the shape of the sealing member and to prevent deterioration of the sealing effect of the sealing member by preventing the excessive deformation of the sealing member by the pressure of air flowing through the connecting passage.

To attain the principal object, the outboard motor in an aspect of the present invention includes: an engine, an engine cover forming an engine compartment for holding the internal combustion engine therein, and a top cover covering the engine cover from above, the top cover being connected to the engine cover and provided with a carrying grip to be used for carrying the top cover, the outboard motor comprising: an intermediate member placed in a space between the engine cover and the top cover; first connecting parts arranged in a space between the engine cover and the intermediate member to connect the engine cover and the intermediate member; and second connecting parts arranged in a space between the top cover and the intermediate member to connect the top cover and the intermediate member.

The engine cover and the intermediate member are connected by the first connecting parts arranged in the space between the engine cover and the intermediate member, and the top cover and the intermediate member are connected by the second connecting parts arranged in the space between the intermediate member and the top cover. Thus, the engine cover and the top cover are connected by the intermediate member. Since the intermediate member is interposed between the engine cover and the top cover with respect to a vertical direction, a space defined by the engine cover and the top cover is divided by the intermediate member, and hence the vertical distance between the engine cover and the intermediate member and the vertical distance between the intermediate member and the top cover are shorter than the vertical distance between the engine cover and the top cover. Therefore, the respective heights of the first and second connecting parts are small, and hence the first and second connecting parts ensure required rigidity. Since the vertical distance between the engine cover and the top cover places only a few restrictions on the arrangement of the first and second connecting parts, the degree of freedom of arranging the first and second connecting parts is increased. In case the top cover is large and an air passage is formed between the engine cover and the top cover, the first and second connecting parts can be arranged at optimum positions for forming the engine cover and the top cover in sufficiently rigid structures, and a load placed through the top cover on the engine cover can be uniformly distributed when the top cover is gripped by the carrying grip.

Since the engine cover does not need to be formed in a great height to ensure sufficient rigidity of the connecting parts connecting the engine cover and the top cover, a mold for molding the engine cover may be made small and the engine cover can be manufactured at reduced manufacturing cost.

In a preferred form of the present invention, the intermediate member is provided with air ducts forming part of an air passage extending between a space outside the engine compartment and a space inside the engine compartment, and the air ducts project upward in the air passage.

Since the intermediate member is provided with the air ducts projecting upward in the air passage and capable of stopping water, the engine cover has a simple shape as compared with an engine cover provided with those air ducts and hence the engine cover can be manufactured at reduced cost.

Preferably, the air passage has an intake silencer for conducting intake air to be sucked into the engine, and the intake silencer is formed by the intermediate member and the top cover in the air passage.

Since the intermediate member and the top cover forms the intake silencer, the shape of the engine cover is simple as compared with that of a top cover used for forming an intake silencer. Therefore, the engine cover can be manufactured at reduced cost. Since the intake silencer is separated from the engine compartment in which air is heated by the engine by the space defined by the engine cover and the intermediate member, it is possible to suppress heating of intake air for combustion gas flowing in the intake silencer by heat radiated from the engine cover and hence the volumetric efficiency of the engine is enhanced.

Preferably, the air passage includes a passage for conducting ventilation air for ventilating the engine compartment into the engine compartment, and the intermediate member and the top cover form the air passage.

Since the air passage through which ventilation air flows is formed by the intermediate member and the top cover, the air passage is separated from the engine compartment in which air is heated by the engine by the space defined by the engine cover and the intermediate member, it is possible to suppress the heating of ventilation air flowing in the air passage by heat radiated from the engine cover and hence the engine can be effectively cooled by ventilation air.

To attain the above objects, in another aspect of the present invention, the internal combustion engine is provided with an intake system for carrying intake air into combustion chambers of the engine, the intake system being disposed in the engine compartment, an outer covering structure including the top cover covers the engine cover from above, the engine cover and the outer covering structure form an air-intake space having an air-intake opening through which external air flows into the air-intake space, the intake silencer is formed in the air-intake space, the intake silencer having an upstream inlet end through which intake air flows from the air-intake space into the intake silencer and a downstream outlet end through which intake air flows from the intake silencer into the intake system, and the air-intake opening extends at least on either of the right and left sides of the upstream inlet end in a longitudinal range between a position corresponding to the rear end members of the engine and a position on a front side of a center axis of a crankshaft included in the internal combustion engine.

Since the intake silencer is interposed between the intake system disposed in the engine compartment and the air-intake space, the transmission of intake pulsation from the intake system to the air-intake space is suppressed, and hence noise resulting from the vibration of the engine cover forming the air-intake space is reduced.

Since the air-intake opening extends at least on either of the right and left sides of the upstream inlet end in the longitudinal range between a position corresponding to the rear end members of the engine body and a position on the front side of the center axis of the crankshaft of the engine, the air-intake opening has a large length in the longitudinal direction, the large air-intake opening has a high effect on preventing water and foreign matters from entering the air-intake space, and hence the flow of water through the upstream inlet end into the intake silencer and the mixing of water with intake air can be effectively prevented.

Preferably, the air-intake opening opens rearward at a rear end of the air-intake space, and the downstream outlet end is on a rear side of the upstream inlet end.

Since the upstream inlet end of the intake silencer is on the front side of the downstream outlet end, it is difficult for water flowing forward into the air-intake space to flow through the upstream inlet end. Thus, the flow of water into the intake silencer can be suppressed.

Further, water flowing into the air-intake space is drained from the intake silencer in lateral directions, and hence the flow of water through the upstream inlet end into the intake silencer and the mixing of water with intake air can be effectively prevented.

In a preferred form of the present invention, the engine cover is provided with a protruding part protruding into the air-intake space at the same lateral position as the upstream inlet end between the air-intake opening and the upstream inlet end with respect to the longitudinal direction.

Since the protruding part obstructs the flow of water moving forward through the air-intake opening to the upstream inlet end, water is prevented from flowing into the upstream inlet end.

Preferably, the upstream inlet end and the downstream outlet end are spaced apart from each other with respect to the longitudinal direction and are disposed on a front side and on a rear side, respectively, of the center axis of the crankshaft, and the longitudinal range extends beyond opposite longitudinal ends of a range in which the upstream inlet end and the downstream outlet end are arranged.

Since the air-intake opening extends longitudinally beyond the opposite longitudinal ends of the range in which the upstream inlet end and the downstream outlet end are arranged on the opposite longitudinal sides of the center axis of the crankshaft, the air-intake opening is elongated and hence the air-intake opening can be formed in a small width to suppress entrance of water and foreign matters into the air-intake space.

To attain the above objects, in a further aspect of the present invention, the internal combustion engine includes a cylinder head for defining a combustion chamber, a crankcase, a crankshaft disposed in the crankcase, and an intake system forming an intake passage through which intake air for combustion flows into the combustion chamber, a ventilation system is disposed in the engine compartment, the ventilation system having an outlet ventilation space through which air in the engine compartment is discharged to an outside of the engine compartment, the intake system is provided with an intake passage forming structure forming the intake passage including an air inlet passage opening outside the engine compartment, the ventilation system is provided with an exit ventilation structure forming the outlet ventilation space having an outlet ventilation passage opening to an outside of the engine compartment, the intake passage forming structure, the exit ventilation structure and the engine cover are formed separately, and the intake passage forming structure and the exit ventilation structure are disposed in the engine compartment.

Since the intake passage forming structure, the exit ventilation structure and the engine cover are formed separately, heat exchange between intake air flowing through the intake passage and air flowing through the discharge passage is suppressed, volumetric efficiency is increased, there are only a few restrictions on the arrangement of the intake passage forming structure and the exit ventilation structure in the engine compartment and the degree of freedom of arranging the intake passage forming structure and the exit ventilation structure is increased. Therefore, the intake passage forming structure and the exit ventilation structure can be formed in optimum functional shapes, respectively, to enhance volumetric efficiency and ventilation efficiency.

Preferably, a ventilation air inlet opening opening outside the engine compartment is formed in the engine cover, the ventilation air inlet opening is disposed near the cylinder head with respect to the center axis of the crankshaft as viewed from a direction parallel to the center axis of the crankshaft with respect to a direction in which the ventilation air inlet opening and the outlet ventilation passage are arranged, and the exit ventilation structure is disposed near the center axis on the opposite side of the ventilation air inlet opening with respect to the intake passage forming structure.

Ventilation air flowing through the ventilation air inlet opening into the engine compartment cools the cylinder head of a comparatively high temperature forming the combustion chamber in the engine body, and then flows into the outlet ventilation space formed by the exit ventilation structure. Therefore, the air of a comparatively high temperature in the engine compartment can be efficiently discharged from the engine compartment, the cooling effect of ventilation air can be enhanced and the engine compartment can be ventilated at high ventilation efficiency.

Preferably, the engine is provided with a valve train including a camshaft rotationally driven by the power of the crankshaft transmitted thereto by a valve train driving mechanism, and the intake passage forming structure and the exit ventilation structure are arranged longitudinally and form a transmission cover longitudinally divided into two parts and covering the valve train driving mechanism from above.

Since the intake passage forming structure and the exit ventilation structure are arranged longitudinally to form the transmission cover covering the valve train driving mechanism for rotationally driving the camshaft of the valve train, the intake passage forming structure and the exit ventilation structure can be moved in opposite directions, respectively, for mounting the same on and dismounting the same from the engine. Thus, the transmission cover for covering the valve train driving mechanism can be easily mounted on and dismounted from the engine.

To attain the above objects, in a still further aspect of the present invention, the outboard motor includes a first passage forming member and a second passage forming member joined together with a sealing member therebetween, the first passage forming member and the second passage forming member form a connecting passage extending between a space outside the engine compartment and a space inside the engine compartment, the sealing member has a sealing part in close contact with a joining surface of the first passage forming member, a flexible part which is bent elastically when the sealing part is pressed by the joining surface, and a working surface exposed to the connecting passage and receiving the pressure of a gas flowing through the connecting passage, the working surface has an inner surface facing the joining surface in a direction in which the pressure acts in a state in which the sealing part is in close contact with the joining surface before the pressure acts on the working surface, and the sealing part is pressed against the joining surface when the pressure acts on the inner surface.

The flexible part is bent elastically when the sealing part of the sealing member is pressed against the joining surface of the first or the second passage forming member. Therefore, the first and second passage forming members can be easily connected with the sealing member held therebetween to facilitate work for connecting the first and second passage forming members. Since the pressure of the gas acting on the contact surface presses the sealing part against the joining surface, the pressure of the gas flowing through the connecting passage acts additionally on the sealing part and hence the sealing effect of the sealing member is enhanced.

Preferably, the gas is intake air for combustion to be supplied to the engine, the pressure is negative suction air pressure, and a space connecting to the connecting passage is formed between the joining surface and the inner surface in a direction in which the negative suction air pressure acts on the inner surface before the negative suction air pressure acts on the working surface.

The negative suction air pressure of intake air flowing into the internal combustion engine acting on the contact surface presses the sealing part against the joining surface. Thus, the negative suction air pressure of intake air flowing through the connecting passage increases the pressure pressing the sealing part against the joining surface and improves the sealing effect of the sealing member. The area of the contact surface can be increased by using a space formed when the flexible part is bent.

In a preferred mode, the gas is the ventilation air discharged from the engine compartment, the pressure is a positive ventilation pressure, the contact surface of the sealing part that comes into contact with the joining surface and the inner surface are on a line of action of the ventilation pressure on the inner surface before the ventilation pressure acts on the working surface.

The positive ventilation pressure of the ventilation air discharged from the engine compartment acting on the inside surface presses the sealing part against the joining surface. Thus, the ventilation pressure of the ventilation air flowing through the connecting passage increases the pressure pressing the sealing part against the joining surface and improves the sealing effect of the sealing member. Since the contact surface of the sealing part formed when the flexible part of the sealing member is bent, and the inside surface are on the line of action of the ventilation pressure, the pressure presses the sealing part efficiently against the joining surface to enhance the sealing effect of the sealing member.

Preferably, the sealing member has a hollow, the sealing part is a flexible lip having a shape of a flange, and the flexible part is provided with the hollow to form a thin bendable wall.

The sealing part having the shape of the flexible lip and capable of being easily deformed facilitates connecting work. The hollow is formed in the sealing part to form the flexible thin wall. Thus, the flexible thin wall can be easily formed.

Preferably, the outboard motor further comprises a deformation restricting member, with which the deformed sealing member comes into contact, for preventing the sealing member from being excessively deformed by the pressure.

The sealing member deformed by the pressure of the gas flowing through the connecting passage comes into contact with deformation restricting member and thus sealing member is prevented from excessive deformation, whereby deterioration of the sealing effect of the sealing member due to excessive deformation is prevented.

DESCRIPTION OF THE PREFERRED EMBODIMENTS

An outboard motor S in a preferred embodiment of the present invention will be described with reference to FIGS. 1 to 16.

Figure 1:
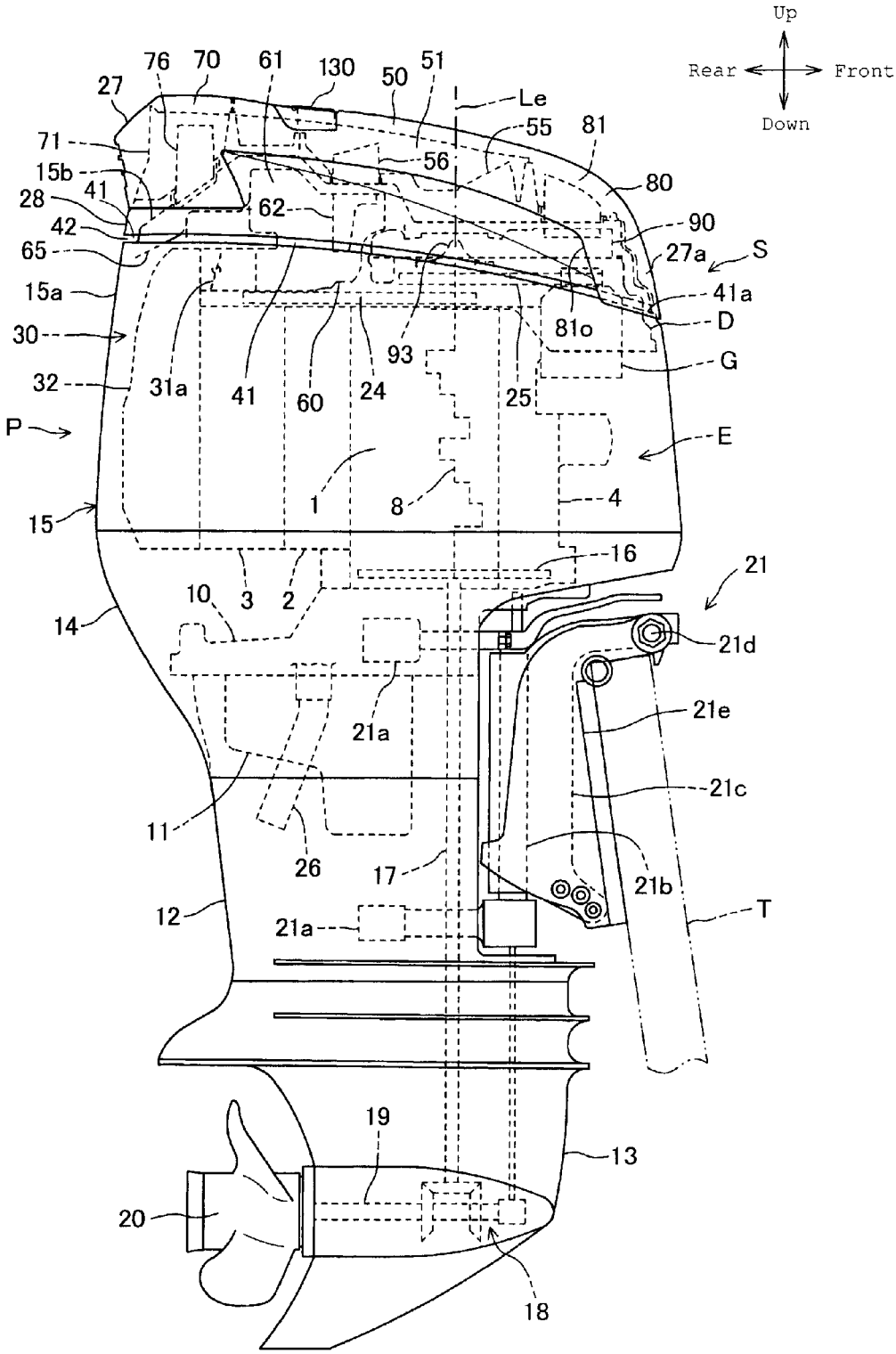
FIG. 1 is a side elevation of an outboard motor in a preferred embodiment of the present invention taken from the right side of the outboard motor.

Referring to FIG. 1, the outboard motor S as a ship-propulsion machine includes a power unit P, a propeller 20, namely, a thrust-producing member, driven by the power unit P, and a holding device 21 for holding the power unit P on a transom of a hull T of a boat. The power unit P includes an internal combustion engine E, a transmission for transmitting the output power of the internal combustion engine E to the propeller 20, covers including an engine cover 15 forming an engine compartment R (FIG. 2) for holding the internal combustion engine E therein, an upstream intake silencer 50 through which intake air for the engine E is taken in, and a ventilation system for ventilating the engine compartment R.

Figure 2:
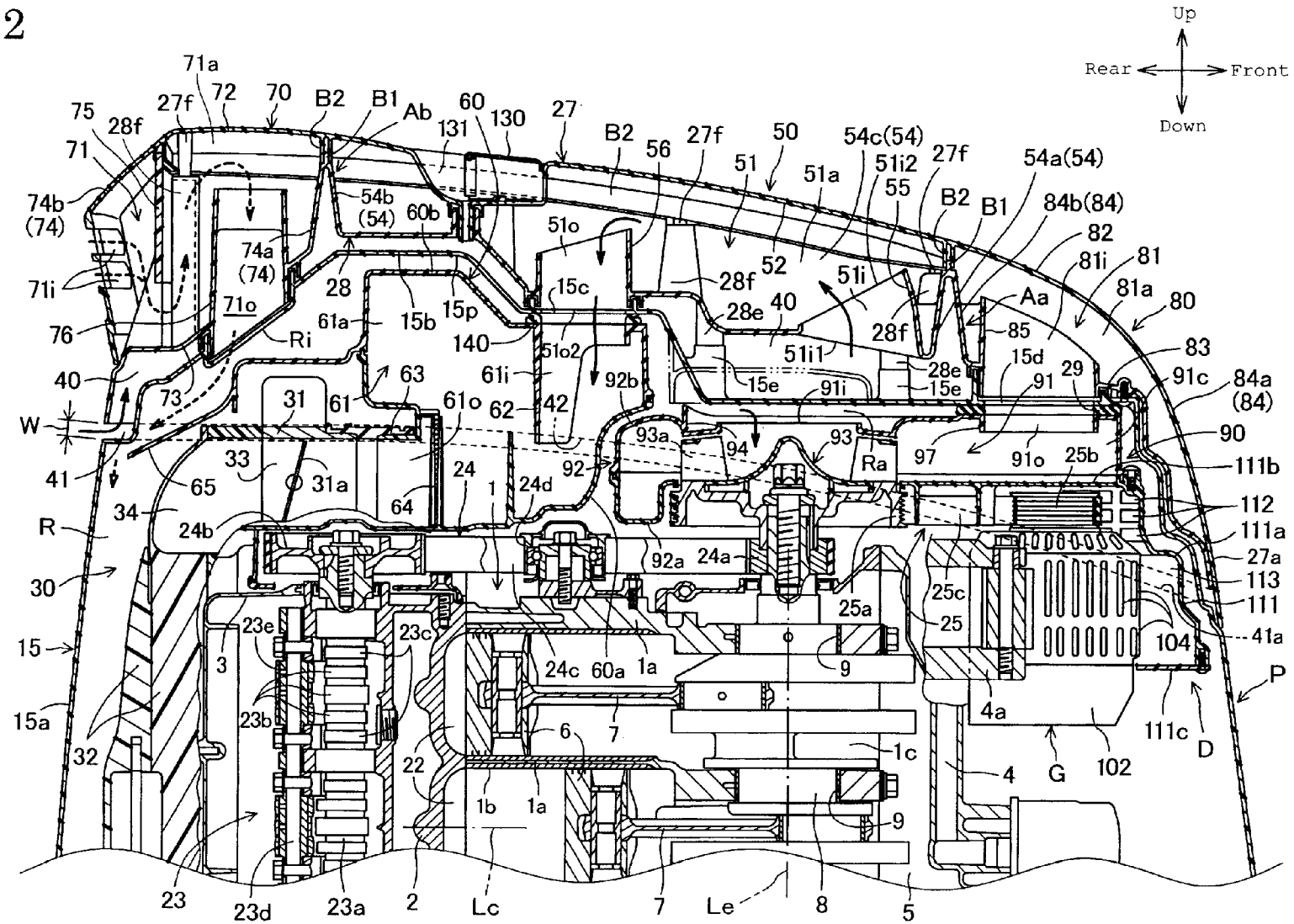
FIG. 2 is a sectional view taken on the line IIa-IIa in FIG. 3 and partly on the line IIb parallel to the axes of cylinders.

Referring to FIG. 2, the internal combustion engine is a vertical V-type four-stroke water-cooled six-cylinder internal combustion engine provided with cylinders 1*a* and a crankshaft 8 having a vertical center axis Le. The internal combustion engine E has an engine body including a V-type cylinder block 1 having two banks provided with six cylinders 1*a* opening rearward and pistons 6 axially slidably fitted in the cylinders 1*a*, respectively, two cylinder heads 2 joined to the rear ends of the two banks, respectively, of the cylinder block 1, valve covers 3 joined to the rear ends, respectively, of the cylinder head 2, and a crankcase 4 joined to the front end of the cylinder block 1 to form a crank chamber 5.

The cylinder heads 2 and the valve covers 3 are rear members of the engine body. The crankcase 4 is a front member of the engine body on the front side of the center axis Le of the crankshaft 8.

The piston 6 fitted in the cylinder bore 1*b* of each cylinder 1*a* is connected to the crankshaft 8 by a connecting rod 7. The crankshaft 8 is disposed in the crank chamber 5 defined by the rear part of the cylinder block 1 and the crankcase 4. The crankshaft 8 is supported for rotation on the cylinder block 1 by main bearings 9.

In the description and claims, directions designated by vertical directions, longitudinal directions and lateral directions correspond to vertical directions, longitudinal directions and lateral directions with respect to the hull T. As shown in FIG. 1, a direction parallel to the center axis Le of the crankshaft 8 is the vertical direction, and the longitudinal directions and the lateral directions are in a horizontal plane perpendicular to the center axis Le. An upward and a downward direction are parallel to the vertical center axis Le, forward and rearward directions are parallel to one of the longitudinal directions and the other longitudinal direction, respectively. A rightward and a leftward direction are one of the lateral directions and the other lateral direction, respectively. Viewing in a plane means viewing from a vertical direction or a direction parallel to the center axis Le. A circumferential direction is parallel to a circumference about the center axis Le unless otherwise specified.

The engine body is joined to the upper end of a mount case 10. An oil pan 11 and an extension case 12 are joined to the lower end of the mount case 10. The oil pan 11 is surrounded by the extension case 12. A gear case 13 is joined to the lower end of the extension case 12. A lower cover 14 is attached to the extension case 12 so as to cover a lower part of the internal combustion engine E, the mount case 10 and an upper part of the extension case 12. An engine cover 15 joined to the upper end of the lower cover 14 covers a greater part, including an upper part, of the internal combustion engine E. The engine cover 15 and the lower cover 14 form an engine compartment R. The internal combustion engine E is disposed in the engine compartment R. The engine cover 15 includes a side wall 15*a* extending horizontally around the center axis Le so as to surround the internal combustion engine E and a top wall 15*b* covering the engine E from above. An alternator G, namely, an accessory of the internal combustion engine E, is installed in the engine compartment E.

A flywheel 16 and a driveshaft 17 are connected to the lower end of the crankshaft 8, namely, the output shaft of the engine E. The driveshaft 17 is driven for rotation by the crankshaft 8. The driveshaft 17 extends vertically through the mount case 10 and the extension case 12 into the gear case 13. The driveshaft 17 is interlocked with a propeller shaft 19 by a forward-rearward change gear 18. A propeller 20 is mounted on the propeller shaft 19. The output power of the internal combustion engine E is transmitted from the crankshaft 8 through the driveshaft 17, the forward-rearward change gear 19 and the propeller shaft 19 to the propeller 20 to rotate the propeller 20. In this embodiment, the center axis of the driveshaft 17 coincides with the center axis Le of the crankshaft 8. The center axis of the driveshaft 17 may be parallel to the center axis Le of the crankshaft 8.

The engine cover 15, the lower cover 14, the mount case 10, the extension case 12 and the gear case 13 are covering members. The drive shaft 17, the forward-rearward change gear 18 and the propeller shaft 19 are the components of the transmission for transmitting the output power of the engine E to the propeller 20.

Referring to FIG. 1, the holding device 21 includes a swivel case 21*c* rotatably supporting a swivel shaft 21*b* fixedly held by mounting rubber cushions 21*a* on the mount case 10 and the extension case 12, a tilt shaft 21*d* supporting the swivel case 21*c* so as to be turnable thereon, and a transom clamp 21*e* holding the tilt shaft 21*d* and fixed to the transom of the hull T. The power unit P including the propeller 20 and supported on the hull T by the mounting device 21 is turnable on the tilt shaft 21*d* in a vertical plane and can turn on the swivel shaft 21*b* in a horizontal plane.

Referring to FIG. 2, each cylinder head 2 forms combustion chambers 22 facing the pistons 6 fitted in the cylinders 1*a*, respectively, and is provided with intake and exhaust ports opening into the combustion chamber 22, and spark plugs provided with electrodes exposed to the combustion chambers 22. The combustion chambers 22 are axially opposite to the pistons 6, respectively. Each cylinder head 2 and the pistons 6 fitted in the cylinder bores 1*b* define the combustion chambers 22, respectively. Intake and exhaust valves placed in each cylinder head 2 are driven to open and close the intake and the exhaust ports in synchronism with the rotation of the crankshaft 8 by an overhead-camshaft valve train 23 installed in a camshaft chamber formed by each cylinder head 2 and a valve cover 3.

The camshaft valve train 23 includes a camshaft 23*a* provided with intake cams 23*b* and exhaust cams 23*c*, a pair of rocker arm shafts 23*d*, intake rocker arms 23*e* supported on one of the rocker arm shafts 23*d*, exhaust rocker arms, not shown, supported on the other rocker arm shaft 23*d*. The camshaft 23*a* is rotationally driven through a valve train driving mechanism 24 by the crankshaft 8. The intake rocker arms 23*e* and the exhaust rocker arms rock on the rocker arm shafts 23*d*, respectively. The intake cams 23*b* and the exhaust cams 23*c* drive the intake valves and the exhaust valves through the intake rocker arms 23*e* and the exhaust rocker arms to open and close the intake valves and the exhaust valves, respectively.

Figure 3:
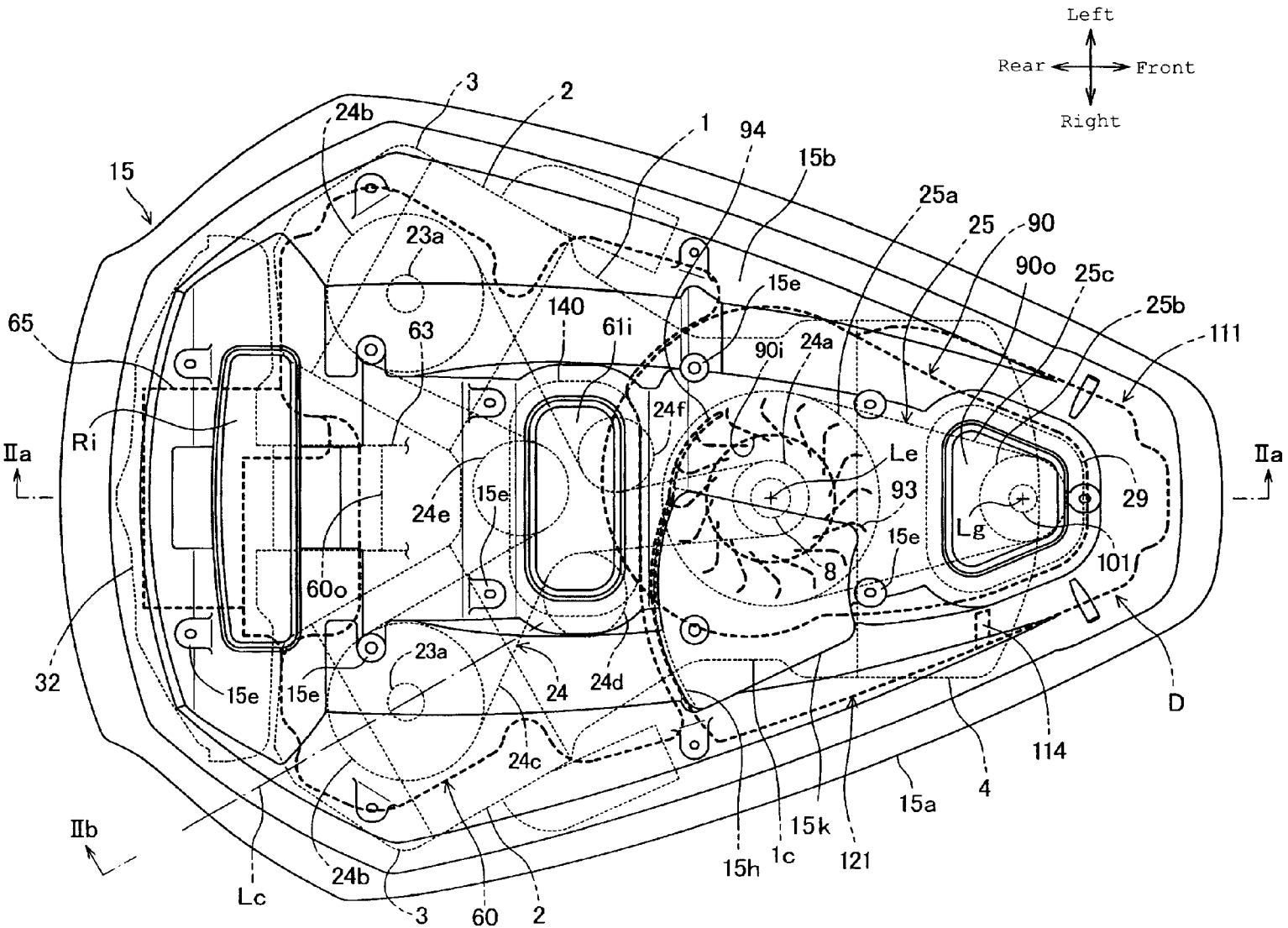
FIG. 3 is a plan view of the outboard motor shown in FIG. 1, in which a top cover and an intermediate cover are removed.

Referring to FIGS. 2 and 3, a valve drive pulley 24*a* and an accessory drive pulley 25*a* are put in that order on an upper end part of the crankshaft 8. The camshaft valve train driving mechanism 24 includes the drive pulley 24*a*, a camshaft pulley 24*b* mounted on the camshaft 23*a*, and a belt 24*c* passed between the drive pulley 24*a* and the camshaft pulley 24*b*. An accessory driving mechanism 25 includes the drive pulley 25*a*, a driven pulley 25*b* mounted on a rotor shaft 101 of the alternator G, and a belt 25*c* passed between the drive pulley 25*a* and the driven pulley 25*b*. The camshaft valve train driving mechanism 24 and the accessory driving mechanism 25 are covered from above with a belt cover structure connected to the upper end of the engine body in the engine compartment R. The belt cover structure includes a downstream intake silencer 60 and an exit ventilation structure 90. The downstream intake silencer 60 is an intake passage forming structure disposed immediately above the cylinder heads 2 and the top cylinders 1*a* and covering a major part of the camshaft pulleys 24*b* and the belt 24*c*. The exit ventilation structure 90 is disposed immediately above the crankcase 5 and covers the driven pulley 25*b*, the belt 24*c* partly and the belt 25*c* entirely. The belt 24*c* is wound around a tension pulley 24*d* and two idle pulleys 24*e* and 24*f*.

The downstream intake silencer 60 and the exit ventilation structure 90, which are disposed in the engine compartment R, are separate structures which are separate from the engine cover 15. The downstream intake silencer 60 and the exit ventilation structure 90 are arranged longitudinally so as to form the belt cover structure divided into front and rear parts and covering the camshaft valve train driving mechanism 24 and the accessory driving mechanism 25.

The internal combustion engine E is provided with an intake system 30 (FIG. 2) disposed in the engine compartment R and forming an intake passage. Intake air for combustion flowing through the intake passage is mixed with fuel ejected by a fuel injection valve to produce an air-fuel mixture. The air-fuel mixture burns to produce combustion gases when ignited in the combustion chambers 22 by the spark plugs. The pistons 6 are driven by the combustion gases to drive the crankshaft 8 for rotation through the connecting rods 7. Referring again to FIG. 1, the combustion gases that have worked in the combustion chambers to drive the crankshaft 8 are discharged from the outboard motor S as an exhaust gas from the combustion chambers 22 through the exhaust ports, an exhaust manifold joined to the cylinder heads 2, an exhaust pipe 26, and an exhaust passage, not shown, formed in the extension case 12, the gear case 13 and the boss of the propeller 20.

Referring to FIGS. 1 to 3, the power unit P has an air-intake structure disposed outside the engine compartment R and immediately above the top wall 15*b* of the engine cover 15. The air-intake structure includes an upstream intake silencer 50 through which air (intake air) for combustion taken in from outside the outboard motor S flows into the intake system 30, and a ventilation passage forming structure for taking external air for ventilation into the engine compartment R and for discharging the air for ventilation from within the engine compartment R or the outboard motor S.

Figure 4:
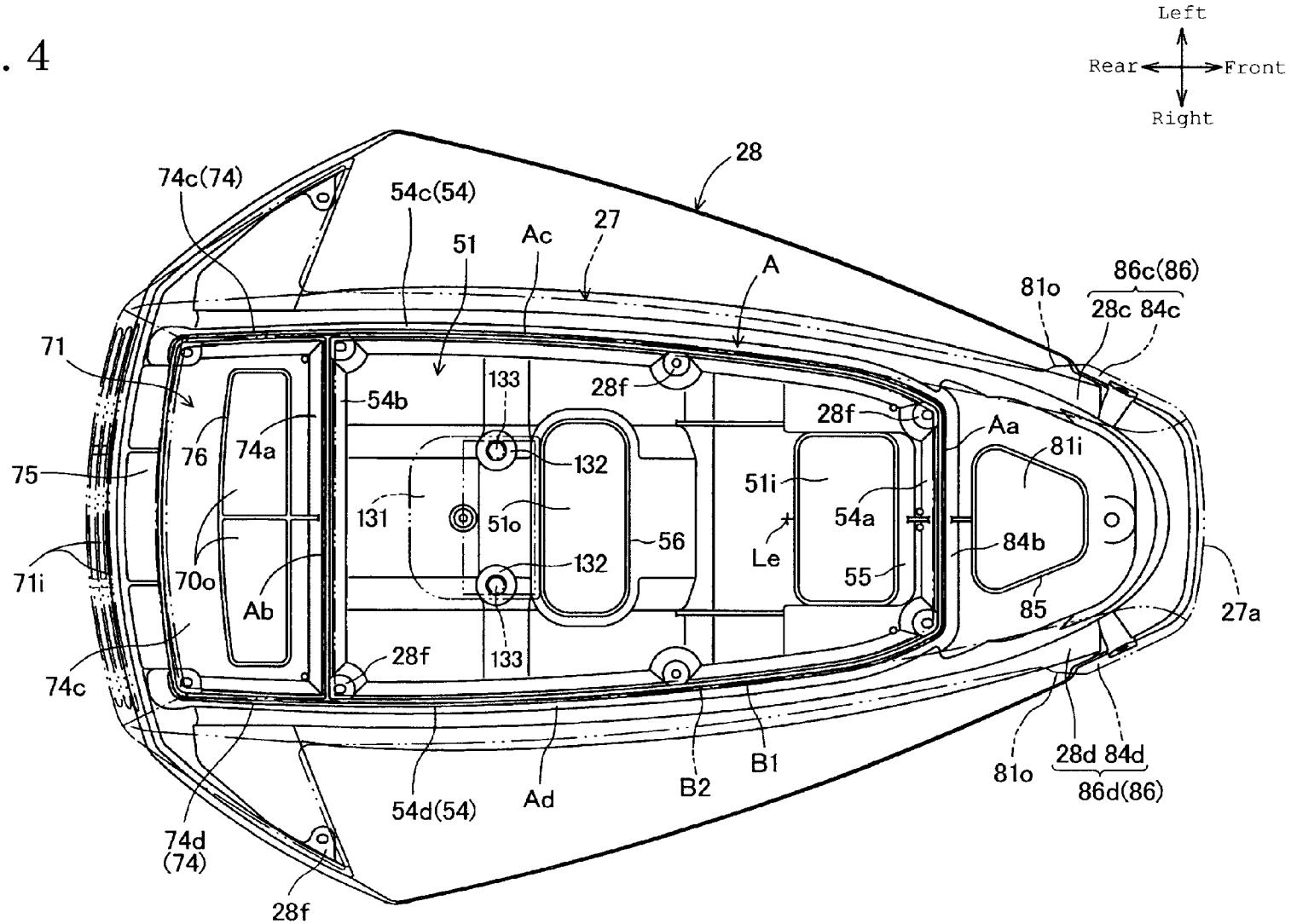
FIG. 4 is a top plan view of the intermediate cover of the outboard motor shown in FIG. 1, in which the top cover is indicated by two-dot chain lines.
Figure 5:
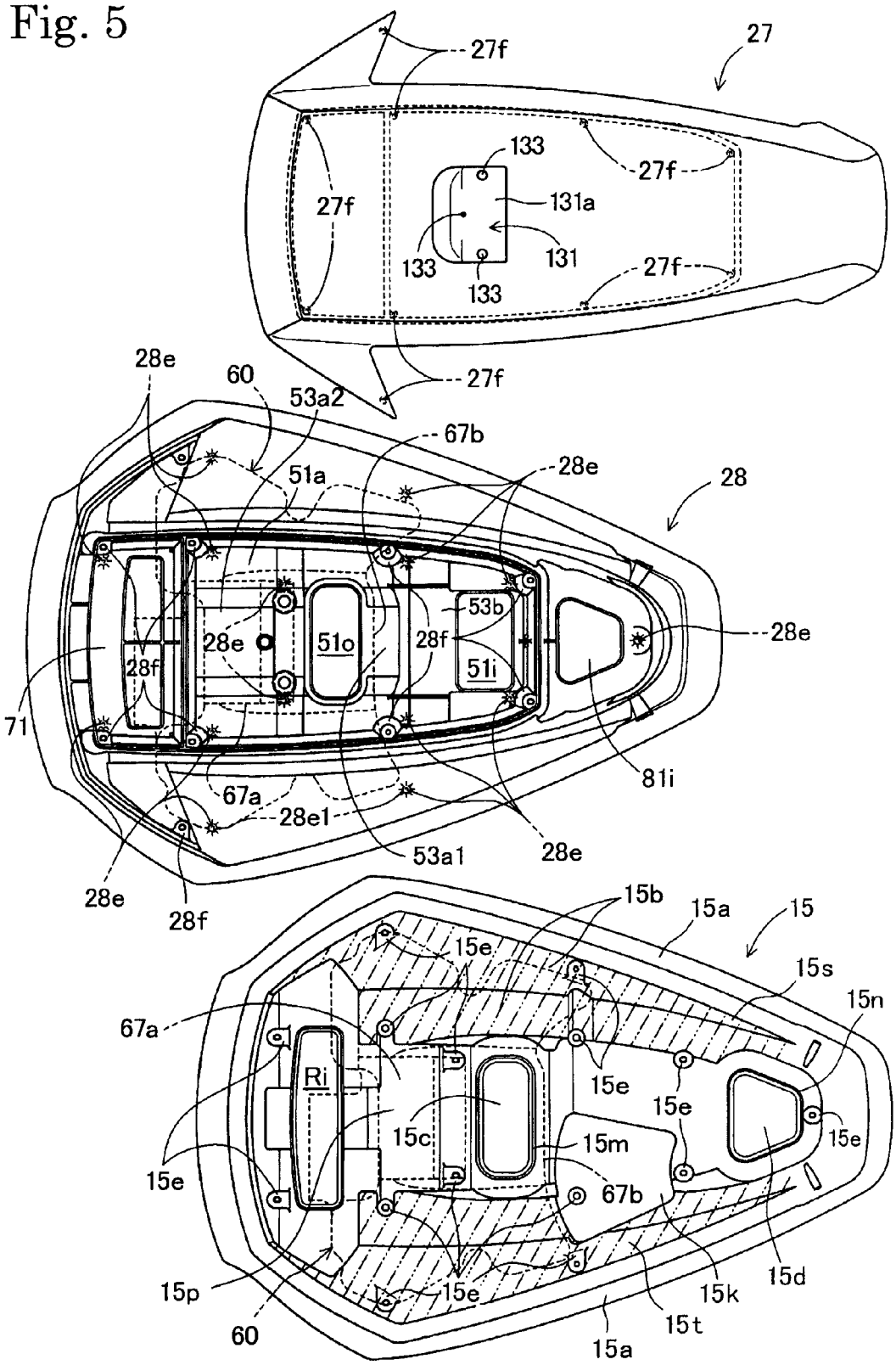
FIG. 5 is a plan view of an engine cover, the intermediate cover and the top cover included in the outboard motor shown in FIG. 1.
Figure 6:
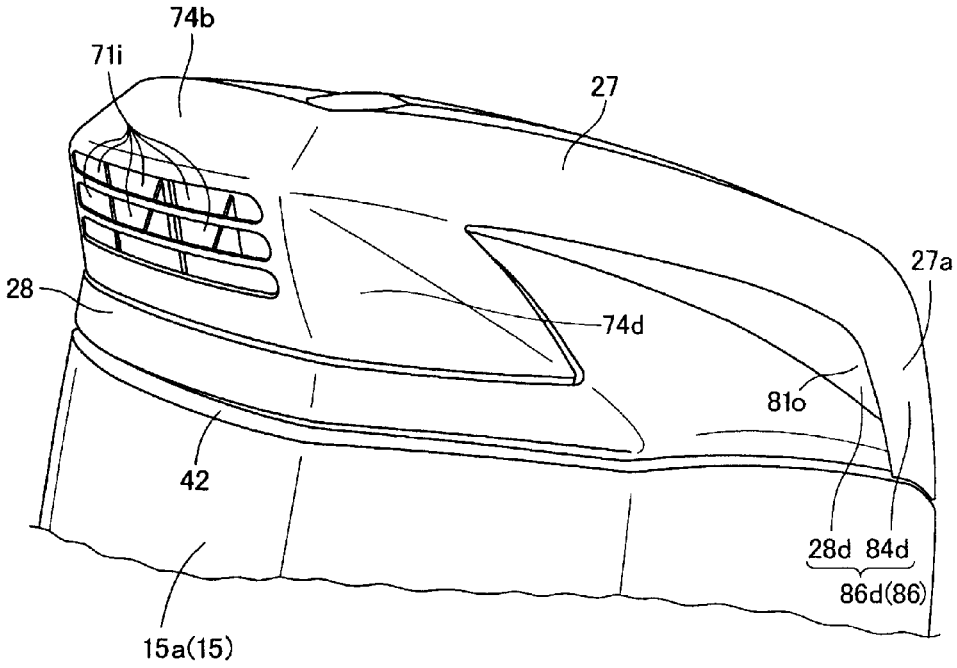
FIG. 6 is a perspective view of an essential part of the outboard motor shown in FIG. 1.

Referring to FIGS. 4 to 6, the air-intake structure includes an outer cover detachably attached to the top wall 15*b* of the engine cover 15. The outer cover forms the external shape of the outboard motor S together with the engine cover 1. The outer cover includes a top cover 27, namely, an upper-end member of the outboard motor S, and an intermediate cover 28 disposed between the top cover 27 and the top wall 15*b*.

The engine cover 15, the top cover 27 and the intermediate cover 28 are unitary, plastic members formed by molding a synthetic resin.

The intermediate cover 28, namely, an intermediate member, is disposed in a space between the engine cover 15 and the top cover 27 and is spaced from the top wall 15*b* of the engine cover 15 and the top cover 27. The top cover 27 is attached to the intermediate cover 28 which is in turn attached to the top wall 15*b*. The engine cover 15 and the top cover 27 are thus fastened to the intermediate cover 28. The whole or a major part of the top cover 15*b* is covered with the intermediate cover 28 from above. A major part of the intermediate cover 28 is covered with the top cover 27 from above. A substantially whole or a major part of the intermediate cover 28 with respect to the longitudinal direction is covered with the top cover 27.

As indicated in FIG. 2, the upstream intake silencer 50, and the ventilation system including an entrance ventilation structure 70 and an exit ventilation structure 80 are formed of parts of the top cover 27 and the intermediate cover 28. The top cover 27 and the intermediate cover 28 form therebetween an upstream intake passage 51 through which intake air flows into the intake passage of the intake system 30, an inlet ventilation passage 71 (see also FIG. 5) through which external air for ventilation flows into the engine compartment R, an outlet ventilation space 81 through which air discharged from the engine compartment R flows to the outside of the top cover 27 and the intermediate cover 28, namely, into the atmosphere.

A space extending between the intermediate cover 28 and the top wall 15*b* of the engine cover 15 is an air-intake space 40 through which external air taken in as intake air flows into the upstream intake passage 51.

Thus, under and over the intermediate cover 28 are formed a lower space including the air-intake space 40, and a lower space including the inlet ventilation passage 71, the upstream intake passage 51 and the outlet space 81, respectively. Parts of the top wall 15*b* and the intermediate cove 28 touch each other to prevent leakage of air between the air-intake passage 40 and the outer outlet ventilation space 81.

Figure 7:
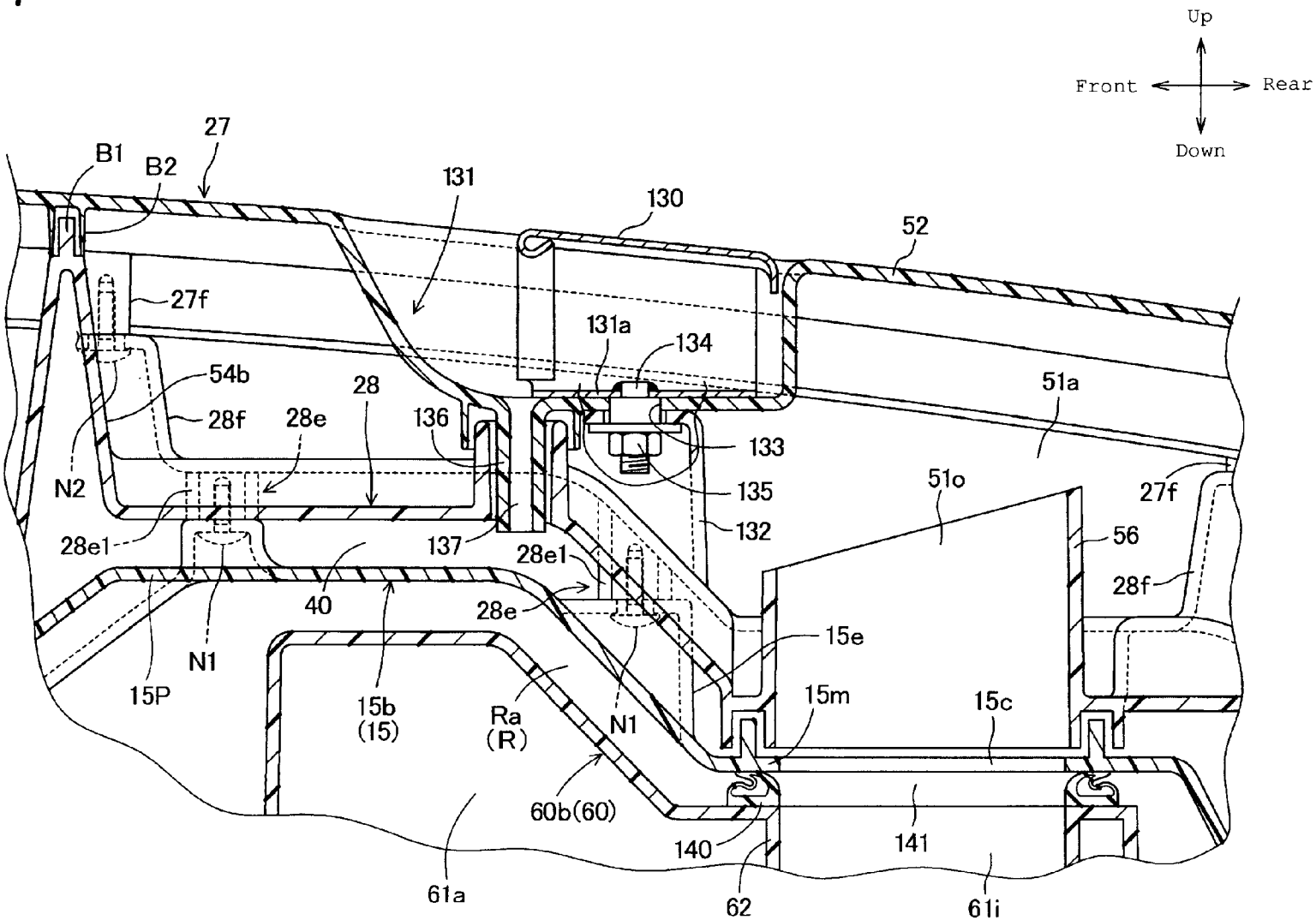
FIG. 7 is an enlarged sectional view of FIG. 2, showing a part around a grip.

Referring to FIG. 7 which is an enlarged partial view of FIG. 2, there are provided cylindrical or substantially cylindrical joining protrusions 15*e* of the top wall 15*b* of the engine cover 15, and cylindrical or substantially cylindrical joining protrusions 28*e* of the intermediate cover 28 respectively corresponding to the joining protrusions 15*e*. These joining protrusions 15*e* and 28*e* are fastened together with screws N1, namely, fastening members. The joined joining protrusions 15*e* and 28*e* determine the vertical distance between the top wall 15*b* and the intermediate cover 28.

As shown in FIG. 2, the air-intake space 40 has a peripheral opening 41. The peripheral opening 41 extends along the circumference of the engine cover 15 and the lower edge of the intermediate cover 28. The width W of the peripheral opening 41 (FIGS. 2 and 12) is equal to the distance between the boundary of a side wall 15*a* and the top wall 15*b* of the engine cover 15, and the lower edge of the intermediate cover 28. A front part 41*a* (FIG. 1) of the peripheral opening 41 is closed by a front end part 27*a* of the top cover 27. The peripheral opening 41 excluding the front part 41*a* serves as an air-intake opening 42. External air for combustion flows through the air-intake opening 42 into the air-intake space 40. When a main part 81*a* of the outer outlet ventilation space 81 is divided into a front space and a rear space, the front end part 27*a* of the top cover 27 on the front side of the upstream intake silencer 50 is disposed at substantially the same position as the front space. Water is restrained from flowing through the air-intake opening 42 by the front end part 27*a* of the top cover 27.

As shown in FIG. 7, there are provided a cylindrical or substantially cylindrical joining protrusions 27*f* of the top cover 27, and cylindrical or substantially cylindrical joining protrusions 28*f* of the intermediate cover 28 respectively corresponding to the joining protrusions 28*f*. These joining protrusions 27*f* and 28*f* are fastened together with screws N2, namely, fastening members. The joined protrusions 27*f* and 28*f* determines the distance between the vertical distance between the top cover 27 and the intermediate cover 28.

The top cover 27 and the intermediate cover 28 united together are connected to the engine cover 15, and then the engine cover 15 is joined to the lower cover 14. The engine cover 15 is thus connected to the top cover 27 through the intermediate cover 28.

First joints are each formed by inserting the screw N1 through the joining protrusion 15*e* and screwing the screw N1 into the joining protrusion 28*e*. The first joints are distributed in the air-intake space 40 defined by the engine cover 15 and the intermediate cover 28. The joining protrusions 15*e* protruding upward from the top wall 15*b* are formed integrally with the top wall 15*b* so as to correspond to the joining protrusions 28*e*, respectively. The joining protrusions 28*e* protruding downward from the intermediate cover 28 is formed integrally with the intermediate cover 28.

The upstream intake silencer 50 and the entrance ventilation structure 70 are spaced apart from the top wall 15*b* of the engine cover 15 by the first joints to form the air-intake space 40 between the engine cover 15 and the upstream intake silencer 50 and between the engine cover 15 and the entrance ventilation structure 70.

Second joints are each formed by inserting the screw N2 through the joining protrusion 28*f* and screwing the screw N2 into the joining protrusion 27*f*. The second joints are distributed in the inlet ventilation passage 71 and in an upstream expansion chamber 51*a*. The joining protrusions 28*f* are formed integrally with the intermediate cover 28 so as to protrude upward from the intermediate cover 28 and so as to correspond to the joining protrusions 27*f*, respectively. The joining protrusions 27*f* are formed integrally with the top cover 27 so as to protrude downward.

Each joining protrusion 28*e* is provided with ribs 28*e*1 extending radially outward from the joining protrusion 28*e* to rigidify the joining protrusion 28*e*. As shown in FIGS. 4 and 5, the joining protrusions 28*f* of a vertical length greater than those of the joining protrusions 15*e*, 28*e* and 27*f* are formed integrally with a side wall 54 of the upstream intake silencer 50. The longer joining protrusions 28*f* are reinforced and rigidified by the side wall 54.

Figure 8:
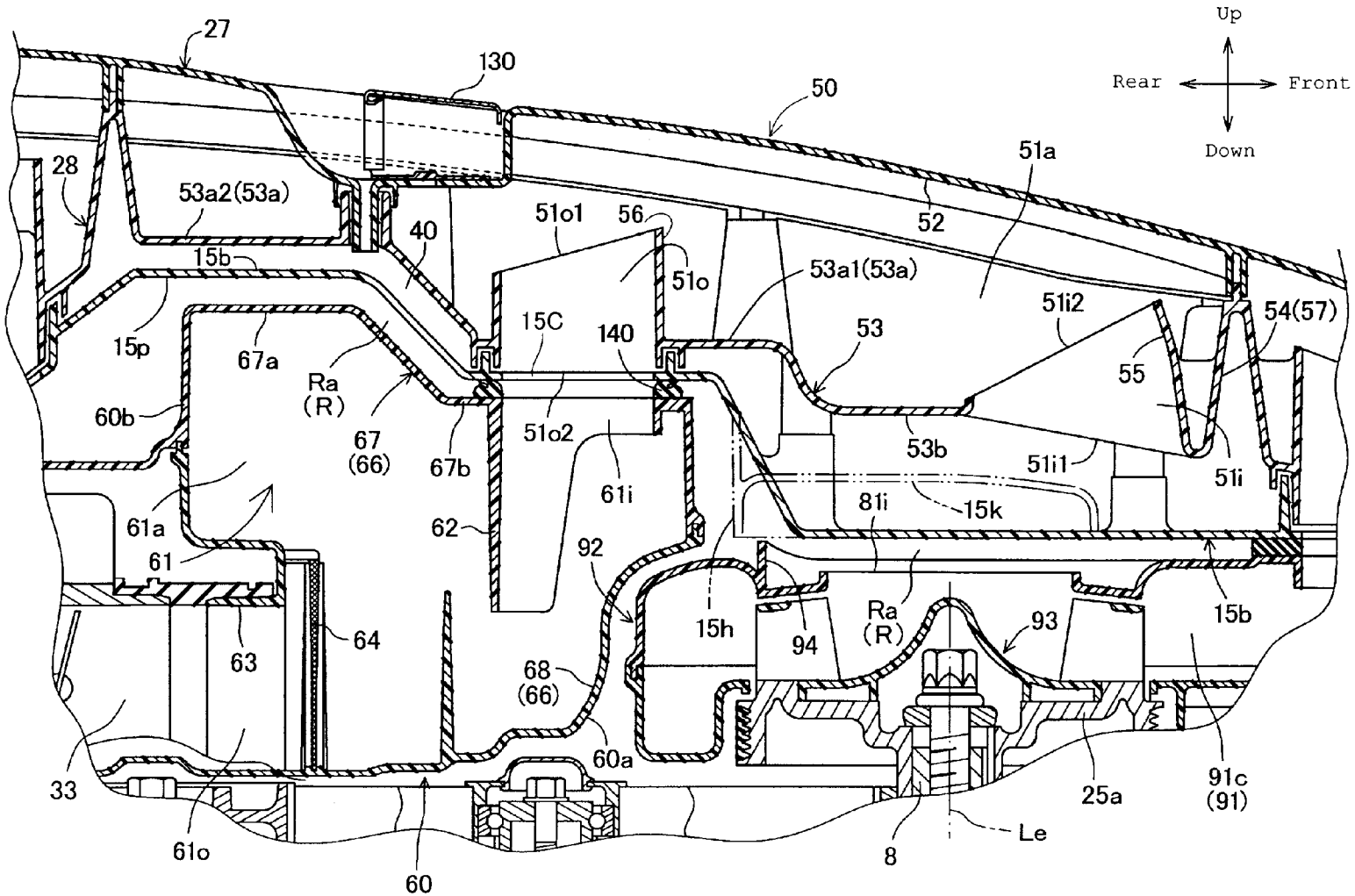
FIG. 8 is an enlarged sectional view of FIG. 2, showing a part around intake silencers.

Referring to FIGS. 7 and 8, the upstream intake silencer 50 disposed outside the engine compartment R and forming the upstream intake passage 51 has an upper wall 52, namely, a part of the top cover 27, a lower wall 53, namely, a part of the intermediate cover 28, a circumferential side wall 54, namely, a part of the intermediate cover 28, extending between the upper wall 52 and the lower wall 53, an upstream entrance duct 55 formed by a part of the intermediate cover 28, and an upstream exit duct 56 formed by a part of the intermediate cover 28. As shown in FIG. 8, the lower wall 53 is vertically opposite to the top wall 15*b* of the engine cover 15 with the air-intake space 40 therebetween. As shown in FIG. 4, the circumferential side wall 54 of the upstream intake silencer 50 has a front part 54*a*, a rear part 54*b*, a left part 54*c* and a right part 54*d*. The upstream entrance duct 55 is separated upward from the top wall 15*b* of the engine cover 15.

As shown in FIG. 7, the upper wall 52 of the upstream intake silencer 50 is provided with a grip 130. The grip 130 is gripped to move the assembly of the top cover 27, the intermediate cover 28 and the engine cover 15 when the engine cover needs to be connected to or disconnected from the lower cover 14. The grip 130, namely, an individual member separate from the top cover 27, is placed in a recess 131 formed in the upper wall 52 of the upstream intake silencer 50, and is fastened to a pair of joining protrusions 132 formed integrally with the intermediate cover 28 by passing bolts 134 through openings 133 formed in a bottom wall 131*a* defining the bottom of the recess 131, and screwing nuts 135 on the bolts 134, respectively. A protrusion 136 formed integrally with the bottom wall 131*a* extends downward through the upstream expansion chamber 51*a* into the air-intake space 40. The protrusion 136 is provided with a drain hole 137 opening into the air-intake space 40 to drain water that has entered the recess 131.

Referring to FIG. 8, the lower wall 53 is a stepped wall having a raised part 53*a* overlapping the downstream intake silencer 60 in a plane, and a lowered part 53*b* separated from the downstream intake silencer 60 in a plane and at a level lower than that of the high part 53*a*. The raised part 53*a* behind the lowered part 53*b* has a first raised part 53*a*1 provided with the upstream exit duct 56 forming an upstream outlet passage 51*o*, and a second raised part 53*a*2 extending behind the first raised part 53*a*1 at a level higher than that of the first raised part 53*a*1.

Referring to FIGS. 2, 7 and 8, the upstream intake passage 51, through which intake air flows into the internal combustion engine E, has the upstream expansion chamber 51*a*, namely, an intake silencing chamber, defined by a structure 57 formed of the upper wall 52, the lower wall 53 and the side wall 54, an upstream inlet passage 51*i* defined by the upstream entrance duct 55 through which air flows from the air-intake space 40 into the upstream expansion chamber 51*a*, and the upstream outlet passage 51*o* defined by the upstream exit duct 56. Intake air taken in through the air-intake opening 42 flows through the upstream entrance duct 55 into the upstream expansion chamber 51*a*. Intake air flows from the upstream expansion chamber 51*a* through the upstream outlet passage 51*o* into a downstream inlet passage 61*i*. The sectional area of the upstream expansion chamber 51*a* into which intake air flows from the air-intake opening 40 is greater than those of the upstream inlet passage 51*i* and the upstream outlet passage 51*o*.

The upstream inlet passage 51*i* has an upstream end 51*i*1 opening toward the air-intake space 40, and a downstream end 51*i*2 opening into the upstream expansion chamber 51*a*. The upstream outlet passage 51*o* has an upstream end 51*o*1 opening into the upstream expansion chamber 51*a*, and a downstream end 51*o*2 opening into a downstream inlet passage 61*i*. The upstream outlet passage 51*o* opens into an opening 15*c* formed in the top wall 15*b* of the engine cover 15. An annular sealing member 140 is clamped between a part of the top wall 15*b* around the opening 15*c* and a downstream entrance duct 62 forming the downstream inlet passage 61*i*.

The upstream outlet passage 51*o* and the downstream inlet passage 61*i* are so aligned as to form a vertical, straight passage.

The upstream end 51*i*1 of the upstream inlet passage 51*i* opens into the air-intake space 40. The upstream inlet passage 51*i* and the upstream outlet passage 51*o* are longitudinally spaced apart from each other and are on the front and the rear side, respectively of the center axis Le. The downstream end 51*o*2 of the upstream outlet passage 51*o* is on the rear side of the upstream end 51*i*1 of the upstream inlet passage 51*i*.

Figure 10:
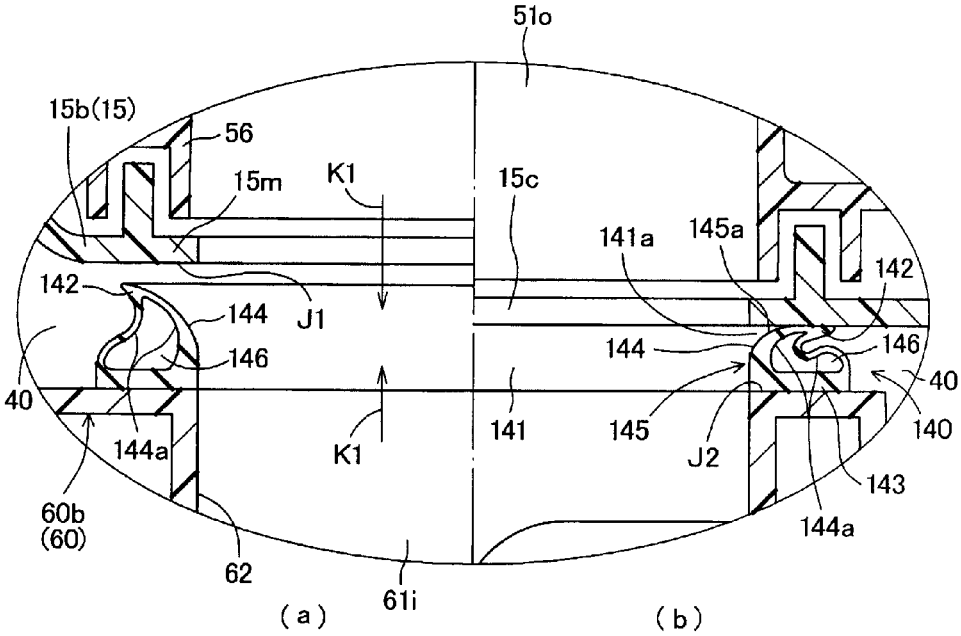
FIG. 10 is an enlarged view of an essential part around a downstream entrance duct shown in FIG. 2, in which (a) shows a disconnected state before a passage forming member and the downstream entrance duct are connected and (b) shows a connected state after the passage forming member and the downstream entrance duct have been connected.

Referring to FIGS. 2, 7 and 10, the sealing member 140 is clamped between a circumferential edge 15*m* of the top wall 15*b* of the engine cover defining the opening 15*c*, and the downstream entrance duct 62 formed integrally with an upper case 60*b* included in the downstream intake silencer 60. The sealing member 140 forms a connecting passage 141 connecting the opening 15*c* at the downstream end of the upstream outlet passage 51*o* and the downstream inlet passage 61*i*. When the engine cover 15 combined with the top cover 27 and the intermediate cover 28 is joined to the lower cover 14 (FIG. 1) so as to cover the internal combustion engine E mounted on the mount case 10 (FIG. 1) from above, the circumferential edge 15*m* and the downstream entrance duct 62 are joined with the sealing member 140 clamped between the circumferential edge 15*m* and the downstream entrance duct 62.

The circumferential edge 15*m* and the downstream entrance duct 62 have joining surfaces J1 and J2, respectively. The joining surfaces J1 and J2 are opposite to each other with respect to joining directions K1. The sealing member 140 is clamped tight between the joining surfaces J1 and J2 to seal gaps between the circumferential edge 15*m* and the downstream entrance duct 62. The joining surfaces J1 and J2 are flat surfaces substantially perpendicular to the joining directions K1 or the main flow of the intake air flowing from the upstream outlet passage 51*o* through the opening 15*c* and the connecting passage 141 into the downstream inlet passage 61*i*.

The sealing member 140 is made of an elastomer, namely, an elastic material having rubber-like elasticity. The sealing member 140 has a sealing lip 142 to be pressed closely against the joining surface J1 of the circumferential edge 15*m*, namely, a first passage forming member, a body 143, namely, a fixed sealing part, firmly fixed to the joining surface J2 of the downstream entrance duct 62 by fixing means, such as baking, a flexible circumferential side part 144 that is bent or curved elastically when the circumferential edge 15*m* is placed close to the downstream entrance duct 62 with a gap between the circumferential edge 15*m* and the downstream entrance duct 62 in a connected state shown in FIG. 10(*b*) and the lip 142 pressed against the joining surface J1 as shown FIG. 10(*b*) to join the engine cover 15 and the intermediate cover 28, and an inside surface 145 exposed to the connecting passage 141 and being subjected to the pressure of intake air.

The sealing member 140 is provided with a hollow 146 filled up with air of a pressure that permits the flexible circumferential side part 144 to be bent.

The flexible lip 142 that can come into contact with and separate from the joining surface J1 extends away from the connecting passage 141 like a flange into the air-intake space 40 in a disconnected state shown in FIG. 10(*a*). The flexible lip 142 curves toward the air-intake space 40 when the flexible circumferential side part 144 is bent.

Since the sealing member 140 is provided with the hollow 146, the flexible circumferential side part 144 has a thin wall 144*a* capable of being easily bent. A similar thin wall 144*a* is provided on the radially outer side part of the sealing member 140.

The inside surface 145 of the sealing member 140 has a sealing surface 145*a*. The sealing surface 145*a* faces the joining surface J1 in a direction in which an intake suction air pressure (negative pressure) acts in the connecting passage 141 in the connected state in which the sealing member 140 is clamped between the circumferential edge 15*m* and the downstream entrance duct 62 and in which no negative pressure is acting on the inside surface 145. In this state, the sealing surface 145*a* and the joining surface J1 forms a space 141*a* continuous with the connecting passage 141.

The sealing member 140, which seals the opening 15*c*, the downstream inlet passage 61*i* and the connecting passage 141 from the air-intake space 40, has the inside surface 145 facing the connecting passage 141, and an outside surface exposed to the air-intake space 40 surrounding the connecting passage 141. Part of the sealing surface 145*a* is a part of the flexible circumferential side part 144.

The negative suction air pressure acts in a direction perpendicular to the sealing surface 145*a*, so that the lip 142 is pressed against the joining surface J1. Consequently, the lip 142 is pressed against the joining surface J1 by both the elasticity of the sealing member 140 and the additional negative suction air pressure.

Figure 9:
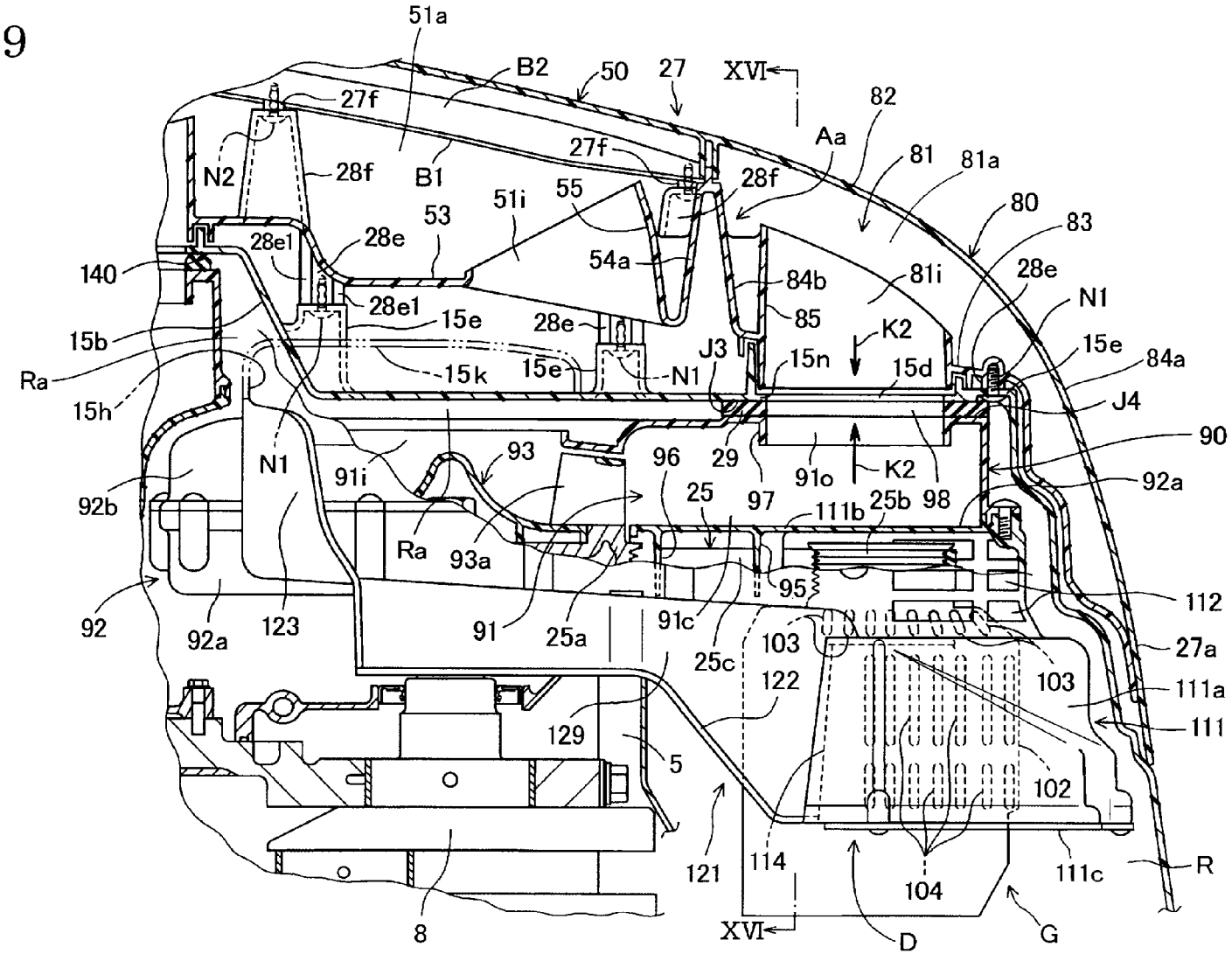
FIG. 9 is an enlarged sectional view of FIG. 2, showing a part around a discharge passage member, in which an air guide structure is partly shown.

Referring to FIGS. 8 and 9, the upstream entrance duct 55 and the upstream exit duct 56 formed integrally with the lower wall 53, which is a part of the intermediate cover 28, do not extend downward from the lower wall 53 but extend upward into the upstream expansion chamber 51*a* from the lower wall 53. The upstream entrance duct 55 restrains water from flowing into the upstream expansion chamber 51*a*, and the upstream exit duct 56 restrains water from flowing into the downstream inlet passage 61*i* and the intake passage. The upstream entrance duct 55 is tilted rearward. Intake air flows obliquely upward through the upstream inlet passage 51*i* and rearward toward the upstream outlet passage 51*o*. Thus, the intake air flows smoothly from the upstream inlet passage 51*i* and the passage resistance of the upstream intake passage 51 is low. The upstream end 51*o*1 of the upstream outlet passage 51*o* extending vertically upward from the lower wall 53 into the upstream expansion chamber 51*a* opens rearward. Therefore, water is restrained from flowing from the upstream inlet passage 51*i* through the upstream expansion chamber 51*a* into the upstream outlet passage 51*o*.

The top wall 15*b* has a protruding part 15*p* protruding upward into the air-intake space 40. The protruding part 15*p* is between the air-intake opening 42 and the upstream inlet end 51*i*1 with respect to the longitudinal direction and at the same lateral position as the upstream end 51*i*1.

Figure 11:
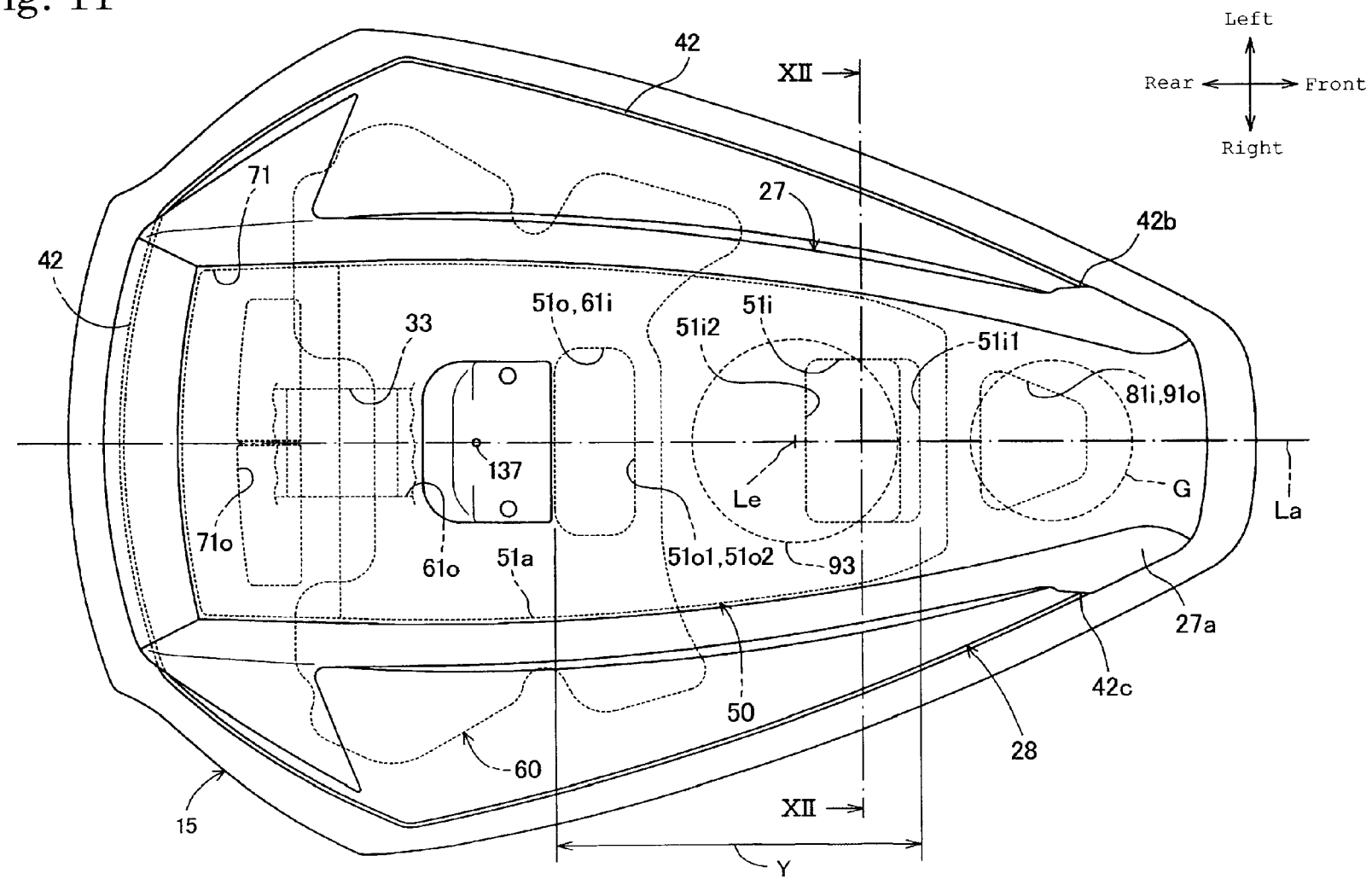
FIG. 11 is a schematic top plan view of the outboard motor shown in FIG. 1.

Referring to FIGS. 8, 9 and 11, the air-intake opening 42 extends at a level lower than that of the upstream intake silencer 50 or the upstream expansion chamber 51*a* and the upstream end 51*i*1. The air-intake opening 42 extends in a U-shape on the rear, the right and the left side of the upstream intake silencer 50 or the upstream expansion chamber 51*a* in a plane. Therefore, the air-intake opening 42 opens rearward at the rear end of the air-intake space 40.

The respective front ends 42*b* and 42*c* of the left and the right parts of the air-intake opening 42 are on the front side of the upstream outlet passage 51*o*, the center axis Le, the upstream inlet passage 51*i*, and the upstream intake silencer 50 or the upstream expansion chamber 51*a*. Thus, the right and the left side part of the air-intake opening 42 on the right and the left side of the upstream end 51*i*1 and the downstream end 51*o*2 of the upstream outlet passage 51*o* extend longitudinally beyond the front and the rear end of a longitudinal range Y in which the upstream end 51*i*1 and the downstream end 51*o*2 are arranged. The air-intake opening 42 extends on the right and the left side of the upstream end 51*i*1 in a longitudinal range from the cylinder heads 2 and the valve covers 3 to a position on the front side of the center axis Le.

Thus, the air-intake opening 42 extending around the lower end of the air-intake space 40 can be formed in a long length. Therefore, even though the air-intake opening 42 is formed in a small width W, intake air can be taken in at a necessary intake rate.

Figure 12:
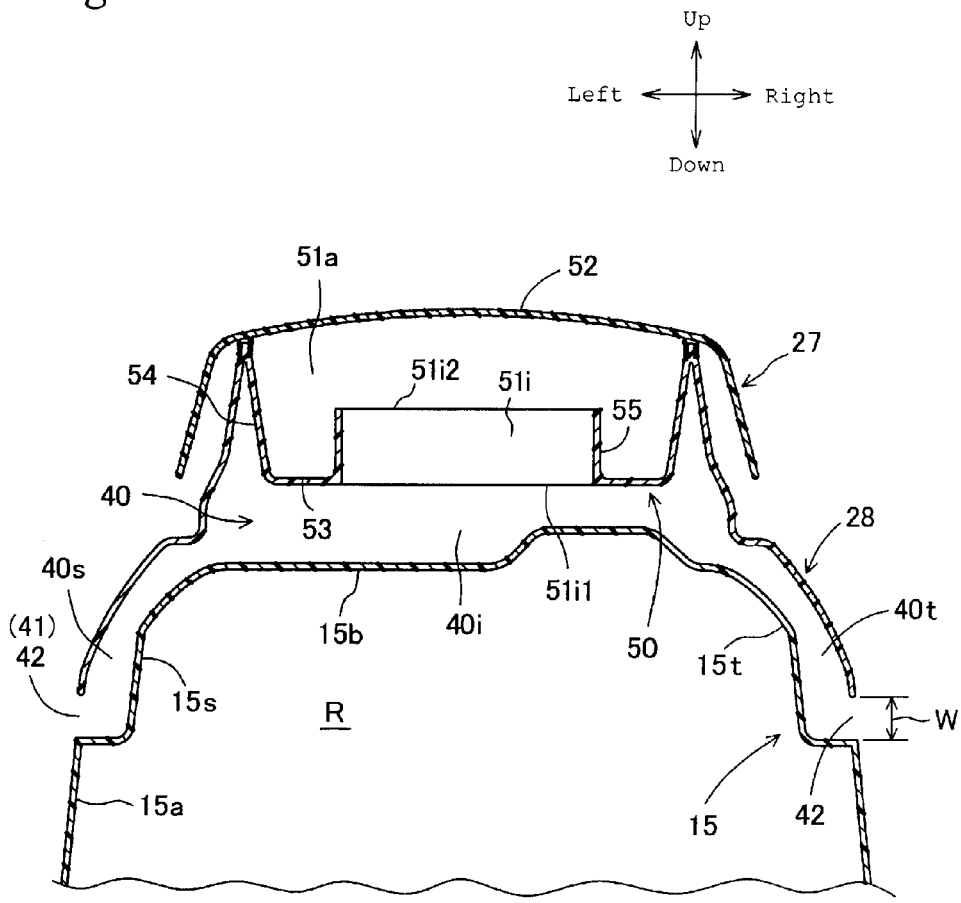
FIG. 12 is a sectional view taken on the line XII-XII in FIG. 11.

Referring to FIGS. 5 and 12, the top wall 15*b* of the engine cover 15 rises from the vicinity of the peripheral opening 41 or the air-intake opening 42. The top wall 15*b* has a right side wall 15*t* and the left side wall 15*s*. In FIG. 5, the side walls 15*t* and 15*s* are shaded by two-dot chain lines. The air-intake space 40 has a right rising space 40*t* extending between the intermediate cover 28 and the right side wall 15*t*, and a left rising space 40*s* extending between the intermediate cover 28 and the left side wall 15*s*. The right rising space 40*t* and the left rising space 40*s* extend upward from the air-intake opening 42. The rising spaces 40*t* and 40*s* are in a longitudinal range between the air-intake opening 42 and the upstream inlet passage 51*i*. Respective upper parts of the rising spaces 40*t* and 40*s* connect to an upper part 40*i* of the air-intake space 40 into which the upstream inlet passage 51*i* opens.

Referring to FIG. 2, the entrance ventilation structure 70 forming the inlet ventilation passage 71 is contiguous with the rear end of the upstream expansion chamber 51*a* of the upstream intake passage 51. The entrance ventilation structure 70 has an upper wall 72, which is a part of the top cover 27, a lower wall 73, which is a part of the intermediate cover 28, and a side wall 74, which is a part of the top cover 27 or the intermediate cover 28, extending between the upper wall 72 and the lower wall 73. The side wall 74 has a front part 74*a*, a left part 74*c* (FIG. 4) and a right part 74*d* (FIG. 6) standing upward from the lower wall 73, and a rear part 74*b* extending obliquely downward from the upper wall 72.

As shown in FIG. 2, the inlet ventilation passage 71 has a main chamber 71*a*, an inlet passage 71*i* (see also FIG. 6) formed in the rear part 74*b* and opening rearward, and an outlet passage 71*o* formed by an exit duct 76 and connecting to a ventilation air inlet opening Ri. Air flows from the main chamber 71*a* through the outlet passage 71*o* and the ventilation air inlet opening Ri into the engine compartment R. The ventilation air inlet opening Ri is formed in the top wall 15*b*. In other words, the ventilation air inlet Ri opens into the outlet passage 71*o* which is located outside the engine compartment R. The sectional area of the main chamber 71*a* is greater than those of the inlet passage 71*i* and the outlet passage 71*o*.

The exit duct 76 is formed integrally with the lower wall 73, which is a part of the intermediate cover 28, and extends upward into the main chamber 71*a* and downward into the ventilation air inlet opening Ri. The exit duct 76 prevents water from flowing through the ventilation air inlet opening Ri into the engine compartment R. A baffle 75 formed integrally with the intermediate cover 28 extends downward in the main chamber 71*a*. The baffle 75 is so disposed that water flowing together with air through the inlet passage 71*i* impinges thereon to restrain water from flowing into the inlet passage 71*o* and the engine compartment R.

The inlet ventilation passage 71 is an air passage extending between the outside and the inside of the engine compartment R.

Referring to FIG. 9, the exit ventilation structure 80 is located contiguous with the front end of the upstream expansion chamber 51*a* and forms the outer outlet ventilation space 81. The exit ventilation structure 80 has an upper wall 82, which is a part of the top cover 27, a lower wall 83, which is a part of the intermediate cover 28, and a side wall 84, which is a part of the top cover 27 and the intermediate cover 28, extending between the upper wall 82 and the lower wall 83. The whole exit ventilation structure 80, i.e., the whole outer outlet ventilation space 81 including the outlet passage 81*o*, is on the opposite side of the cylinder heads 2 with respect to the center axis Le of the crankshaft 8; that is, the exit ventilation structure 80 is on the front side of the center axis Le. The side wall 84 has a front part 84*a* extending downward from the upper wall 82, a left part 84*c* (FIG. 4), a right part 84*d*, and a rear part 84*b*. The front part 84*a*, the left part 84*c* and the right part 84*d* are a part of the top cover 27. The rear part 84*b* is a part of the intermediate cover 28.

The outer outlet ventilation space 81 has the main part 81*a*, an inlet passage 81*i* formed by an entrance duct 85, and an outlet passage 81*o* formed by an exit duct 86 (FIG. 4). Air flows from an outlet ventilation passage 91*o* through the inlet passage 81*i* into the main chamber 81*a*. Air flows from the main chamber 81*a* through the outlet passage 81*o* and is discharged rearward from the outboard motor S. The inlet passage 81*i* opens into an opening 15*d* formed in the top wall 15*b* and opens through the opening 15*d* and an annular sealing member 29 into the outlet ventilation passage 91*o*. The sectional area of the main chamber 81*a* is greater than those of the inlet passage 81*i* and the outlet passage 81*o*.

The spongy sealing member 29 (refer also to FIG. 13) made of rubber is clamped between a passage forming part 15*n* and an exit duct 97 forming an outlet ventilation passage 91*o*. The passage forming part 15*n* is formed integrally with the top wall 15*b* of the engine cover 15 and provided with an opening 15*d*. The exit duct 97, namely, an outlet passage forming member, is formed integrally with an upper case 92*b*, which is a part of the exit ventilation structure 90. The sealing member 29 forms a passage 98 connecting the opening 15*d* of the upstream inlet passage 81*i*, and the outlet ventilation passage 91*o*. The passage forming part 15*n*, namely, a first passage forming member, and the exit duct 97, namely, a second passage forming member, clamps the sealing member 29 when the assembly of the top cover 27, the intermediate cover 28 and the engine cover 15 is joined to the lower cover 14 (FIG. 1).

The passage forming part 15*n* and the exit duct 97 have joining surfaces J3 and J4, respectively, facing each other with respect to joining directions K2. The sealing member 29 is in close contact with the joining surfaces J3 and J4 to seal the gap between the passage forming part 15*n* and the exit duct 97. The joining surfaces J3 and J4 are substantially perpendicular to the joining directions K2 or a main air flow flowing from the outlet ventilation passage 91*o* through the passage 98, the opening 15*d* and the inlet passage 81*i*.

As shown in FIG. 9, the entrance duct 85 formed integrally with the lower wall 83, which is a part of the intermediate cover 28, extends upward into the main chamber 81*a* and extends downward into the opening 15*d*. The entrance duct 85 thus formed restrains water from flowing into the outlet ventilation passage 91*o* and an inner outlet ventilation space 91. As shown in FIG. 4, the exit duct 86 has a part 86*c* formed of the left part 86*c* and a front left part 28*c* of the intermediate cover 28, and a part 86*d* formed of the right part 84*d* and a front right part 28*d* of the intermediate cover 28. The outlet passage 81*o* is formed by the parts 86*c* and 86*d*, and opens rearward into the atmosphere (refer also to FIG. 5).

Referring to FIGS. 2, 4 and 8, the intermediate cover 28 is a frame structure having an upwardly convex wall A (FIG. 8) of double-wall construction having an upwardly convex longitudinal section. The frame structure has a pair of longitudinal side walls Ac and Ad, and a pair of lateral end walls Aa and Ab joining to the longitudinal walls Ac and Ad. The intermediate cover 28 of double-wall construction is rigid.

The side walls 54, 74 and 84 forming the inlet ventilation passage 71 and the outer outlet ventilation space 81 form the upward convex wall A. More concretely, the front and rear parts 54*a* and 84*a* are parts of the end wall Aa. Similarly, the rear and front parts 54*b* and 74*a* are parts of the end wall Ab. The left parts 54*c* and 74*c* are parts of the side wall Ac. The right parts 54*d* and 74*d* are parts of the side wall Ad. A space between the two walls of the upward convex wall A is a part of the air-intake space 40.

An annular protrusion B1 (FIG. 2) and the baffle wall 75 formed integrally with a top part of the upward convex wall A are fitted in recesses B2 formed by a pair of annular protrusions in the top cover to ensure the airtightness of the upstream intake passage 51, the inlet ventilation passage 71 and the outer outlet ventilation space 81.

Referring to FIGS. 1 to 3, the intake system 30 forms the intake passage for carrying intake air from the air-intake passage through the intake ports into the combustion chambers 22. The intake system 30 includes the downstream intake silencer 60 disposed above the engine body, and a throttle device 31 connected to the downstream intake silencer 60. The throttle device 31 is disposed above the engine body and provided with a throttle valve 31*a* for regulating the flow of intake air. The intake system 30 also includes an intake manifold 32 connected to the throttle device 31. The upstream intake silencer 50 and the downstream intake silencer 60 are combined in a vertical arrangement. The upstream intake silencer, is an upstream intake silencer disposed above the downstream intake silencer 60, namely, a lower intake silencer.

Referring to FIG. 2, the intake passage extends continuously in the engine compartment R from the downstream inlet passage 61*i* to the intake ports. The intake passage has a downstream intake passage 61 formed in the downstream intake silencer 60, a throttle passage 33 formed by the throttle body of the throttle device 31 and provided with the throttle valve 31*a*, and a downstream intake passage 34 formed in the intake manifold 32 and communicating with the downstream intake passage 61 by means of the throttle passage 33. Air flows from the downstream intake passage 34 through the outlet of the intake passage into the intake ports. Air is sucked through the intake ports into the combustion chambers 22. The throttle passage 33 extends longitudinally along a straight line La (FIG. 11) in a plane. In this embodiment, the straight line La intersects the center axis Le and is along the longitudinal directions.

The air-intake passage 40, the upstream intake passage 51 having the upstream outlet passage 51*o*, the opening 15*c*, the connecting passage 141, and the intake passage having the downstream inlet passage 61*i* form an intake air passage continuously extending from outside the engine compartment R into the engine compartment R.

Referring to FIGS. 2 and 3, the downstream intake silencer 60 includes a lower case 60*a*, namely, a first case covering the camshaft valve train driving mechanism 24 from above, and an upper case 60*b*, namely, a second case, closely joined to and fastened with screws to the lower case 60*a*. In assembling step, the downstream intake silencer 60 is moved forward to its predetermined position after the outlet ventilation passage forming the exit ventilation structure 90 has been attached to the engine body. Holding parts of the lower case 60*a* are detachably attached to the respective upper ends of the cylinder block 1, the cylinder heads 2 and the valve covers 3.

Referring to FIG. 8, the downstream intake silencer 60 has a wall 66 forming a downstream expansion chamber 61*a*, the downstream entrance duct 62 forming the downstream inlet passage 61*i*, and a downstream exit duct 63 forming the downstream outlet passage 61*o*. The wall 66, the downstream entrance duct 62 and the downstream exit duct 63 form the downstream intake passage 61.

The downstream entrance duct 62 and the downstream inlet passage 61*i* extend vertically, and the downstream exit duct 63 and the downstream outlet passage 61*o* are parallel to the longitudinal direction.

An upper wall 67 of the downstream intake silencer 60 is a stepped wall having a raised part 67*a* and a lowered part 67*b*. The raised part 67*a* underlies the second raised part 53*a*2 of the lower wall of the upstream expansion chamber 51*a*. The lowered part 67*b* underlies the first high part 53*a*1 of the lowered wall 53 and extends at a level lower than that of the raised part 67*a*. The downstream entrance duct 62 and the downstream inlet passage 61*i* are formed in the lowered part 67*b*. The downstream exit duct 63 and the downstream outlet passage 61*o* are disposed under the raised part 67*a* at a level lower than that of the raised part 67*a*.

The upstream intake silencer 50 is disposed immediately above the top wall 15*b*, and the downstream intake silencer 60 is disposed immediately below the top wall 15*b*. The protruding part 15*p* of the top wall 15*b* extends under the second raised part 53*a*2 and the first raised part 53*a*1 of the lower wall 53 and over the raised part 67*a* and the lowered part 67*b* of the upper wall 67. The protruding part 150 protrudes upward in a shape conforming to those of the second raised part 53*a*2, the first raised part 53*a*1, the raised part 67*a* and the lowered part 67*b*. The protruding part 15*p* extends in a space between the raised part 53*a* and the upper wall 67 and is on the rear side of the upstream inlet passage 51*i*.

The downstream inlet passage 61 includes the downstream expansion chamber 61*a*, namely, an expanded intake silencing chamber, the downstream inlet passage 61*i* formed by the downstream entrance duct 62 and connecting to the air-intake space 40 and the downstream expansion chamber 61*a*, and the downstream outlet passage 61*o* formed by the downstream exit duct 63 connecting the downstream expansion chamber 61*a* to the throttle passage 33. The sectional area of the downstream expansion chamber 61*a* of the downstream intake silencer 60, into which intake air flows from the upstream intake silencer 50 through the downstream inlet passage 61*i* is greater than those of the downstream inlet passage 61*i* and the downstream outlet passage 61*o*. The downstream inlet passage 61*i* does not open into the engine compartment R and connects directly to the upstream intake passage 51 outside the engine compartment R. A flame trap 64 made from a metal net is disposed on the upstream side of the downstream outlet passage 61*o* in the downstream expansion chamber 61*a*. The flame trap 64 traps flame when back fire occurs.

Referring to FIG. 2, the ventilation system includes the entrance ventilation structure 70 for carrying external air into the engine compartment R, the exit ventilation structure 90 forming the inner outlet ventilation space 91 (FIG. 9) for carrying, to the outside of the engine compartment R, hot air heated by heat radiated from the internal combustion engine E and the associated devices in the engine compartment R, and the exit ventilation structure 80 for carrying the hot air flowing out from the exit ventilation structure 90 to the outside of the outboard motor S.

Ventilation air flows through the inlet ventilation passage 71 outside the engine compartment R, the outlet passage 71*o* and the ventilation air inlet Ri into the engine compartment R. The ventilation air is guided to a space behind the intake manifold 32, the valve covers 3 and the cylinder heads 2 by a guide plate 65 formed integrally with the upper case 60*b* of the downstream intake silencer 60. Part of the ventilation air that has worked for cooling the intake system 30, the valve covers 3, the cylinder heads 2, the cylinder blocks 1 and the crankshaft cover 4 flows as cooling air into the alternator G held on the crankshaft cover 4 by a bracket 5*a* (FIG. 2). While the ventilation air that has passed through the ventilation air inlet Ri is flowing from a space behind the engine body toward a space in front of the engine body, the ventilation air cools the cylinder heads 2 and the cylinder blocks 1 forming the combustion area. Thus the ventilation air works efficiently as cooling air. The guide plate 65 is formed integrally with the downstream intake silencer 60 and hence does not increase the number of the component parts of the outboard motor S.

Referring to FIG. 9, the exit ventilation structure 90 overlying the accessory driving mechanism 25 includes a case 92 formed by fastening the upper case 92*b*, namely, a second case, to a lower case 92*a*, namely, a first case, with screws in an airtight fashion, a centrifugal fan 93, namely, a blowing means, placed in the inner outlet ventilation space 91 formed by the lower case 92*a* and the upper case 92*b* to deliver air by pressure to the outer outlet ventilation space 81. When mounting the exit ventilation structure 90, it is moved from the front side and fixed to its position. The exit ventilation structure 90 is detachably fastened to the respective upper ends of the cylinder blocks 1 and the crankshaft cover 4 at holding parts F (FIG. 14) of the case 92 and a cover 111, which will be described later.

In FIG. 9, the inner outlet ventilation space 91 is formed in an upper space Ra (FIG. 7) in the engine compartment R. The inner outlet ventilation space 91 has an inlet ventilation passage 91*i* opening upward, the outlet ventilation passage 91*o* connecting to the inlet passage 81*i* of the outer outlet ventilation space 81, and an outlet passage 91*c* for carrying air blown by the fan 93 into the outlet ventilation passage 91*o*. The upper space Ra extends under and along the top wall 15*b* of the engine cover 15 and is positioned at a level above the upper end of the crankshaft 8, the alternator G and the driving mechanisms 24 and 25. The fan 93 is provided with a plurality of blades 93*a* and fastened to the upper end of the accessory drive pulley 25*a* with bolts, not shown, for rotation together with the accessory drive pulley 25*a*, which is fixedly mounted on the upper end part of the crankshaft 8. A part on the side of the outlet ventilation passage 91*o* of the fan 93 overlaps the upstream inlet passage 51*i* in a plane.

The inlet ventilation passage 91*i* and the outlet ventilation passage 91*o* are formed in the upper case 92*b*. The inlet ventilation passage 91*i* is formed under and vertically separated from the top wall 15*b* and disposed in a space above the crankshaft cover 4 in which hot air heated by the cylinder heads 2 and the cylinder blocks 1 tends to collect. Air of a comparatively high temperature which has cooled the engine body and the alternator G in the engine compartment R flows into the inlet ventilation passage 91*i*.

The outlet passage 91*c* of the inner outlet ventilation space 91 and the outer outlet ventilation space 81 are disposed at the same longitudinal position as the alternator G. The outer outlet ventilation space 81, the outlet passage 91*c* and the alternator G are superposed in a plane.

The inner outlet ventilation space 91 having the outlet ventilation passage 91*o*, the passage 98, the opening 15*d*, and the outer outlet ventilation space 81 having the inlet passage 81*i* form a ventilation passage extending between the outside of the engine compartment R and the inside of the engine compartment R. Ventilation air flows through the ventilation passage.

Referring to FIG. 8, the downstream outlet passage 61*o* is on the opposite side of the upstream inlet passage 51*i* with respect to the upstream outlet passage 51*o* and the downstream inlet passage 61*i*. As shown in FIG. 11, the upstream outlet passage 51*o*, the downstream inlet passage 61*i* and the downstream outlet passage 61*o* are arranged across the straight line La crossing the upstream inlet passage 51*i* and the throttle passage 33 in a plane.

Referring to FIG. 2, the inlet passage 71*i*, the outlet passage 71*o*, the ventilation air inlet opening Ri, the upstream outlet passage 51*o*, the downstream inlet passage 61*i*, the downstream outlet passage 61*o*, the upstream inlet passage 51*i*, the outlet ventilation passage 91*o* and the inlet passage 81*i* are arranged in that order in a forward direction on a longitudinal straight line in a plane. The upstream inlet passage 51*i* is on the front side of the upstream outlet passage 51*o* and the downstream inlet passage 61*i*. The inlet passage 71*i*, the outlet passage 71*o*, the ventilation air inlet opening Ri, the upstream outlet passage 51*o* and the downstream inlet passage 61*i* are arranged in a space near the cylinder heads 2 on the rear side of the center axis Le. The upstream inlet passage 51*o*, the outlet ventilation passage 91*o*, the inlet passage 81*i* and the outlet passage 81*o* are arranged in a space near the crankcase 5 on the front side of the center axis Le. The top cover 27 covers the upstream outlet passage 51*o*, the upstream inlet passage 51*i* and the inlet passage 81*i* from above.

The exit ventilation structure 90 is disposed near the center axis Le on the opposite side of the inlet passage 71*i*, the outlet passage 71*o* and the ventilation air inlet opening Ri with respect to the downstream intake silencer 60. A major part of the exit ventilation structure 90 is formed near the center axis Le on the front side of the upstream outlet passage 51*o* and the downstream inlet passage 61*i*. Thus, the downstream intake silencer 60 is disposed on the side of the cylinder heads 2 or in a rear part of the outboard motor S on the rear side of the engine body. The exit ventilation structure 90 is disposed on the side of the crankcase 5 or in a front part of the outboard motor S on the front side of the engine body.

The downstream intake silencer 60 and the exit ventilation structure 90 are separate structures and are separate from the engine cover 15. Therefore, there are not many restrictions on the respective shapes of the downstream intake silencer 60 and the exit ventilation structure 90. For example, the downstream inlet passage 61*i* and the downstream outlet passage 61*o* of the downstream intake silencer 60 can be formed at a short distance from each other to improve intake efficiency. The downstream intake silencer 60 can be disposed in a space through which air of a comparatively low temperature flows in the engine compartment R, while the exit ventilation structure 90 can be disposed in a space through which air of a comparatively high temperature which has cooled the cylinder heads 2 and the cylinder blocks 1 flows in the engine compartment R. The inlet ventilation passage 91*i* and the outlet ventilation passage 91*o* can be formed at a short distance from each other to improve intake efficiency.

Referring to FIG. 2, the alternator G includes a rotor shaft 101 (FIGS. 3 and 13) rotationally driven through the accessory driving mechanism 25 by the crankshaft 8, and a housing 102 housing a rotor mounted on the rotor shaft 101. The rotor is provided with a cooling fan, not shown, for taking air into the housing 102. The housing 102 is provided with inlet openings 103 (FIG. 9) through which cooling air is taken into the housing 102 by the cooling fan to cool the interior of the alternator G, and outlet openings 104 through which cooling air that has worked for cooling the interior of the alternator G is discharged.

Referring to FIG. 9, the alternator G is surrounded by an air guide structure D. The air guide structure D guides cooling air flowing into the alternator G and cooling air that has worked for cooling the interior of the alternator G and discharged from the housing 102 toward the inlet ventilation passage 91*i*. The air guide structure D and the exit ventilation structure 90 are united to form an air discharge structure.

The air guide structure D has a cover 111 extending over the inlet openings 103 and the outlet openings 104 so as to surround the housing 102, and a guide wall 121, namely, a guide member, for guiding air discharged from the alternator G through the outlet openings 104 into a guide space 113 (FIG. 2) defined by the cover 111 and the housing 102 toward the inlet ventilation passage 91*i* of the inner outlet ventilation space 91. The cover 111 and the guide wall 121 are united together and are formed integrally with the lower case 92*a*.

As shown in FIG. 9, the cover 111 has a circumferential wall 111*a*, an upper wall 111*b* and a lower wall 111*c*. The circumferential wall 111*a* extends vertically along the center axis Lg (FIG. 13) of the rotor shaft 101 of the alternator G and circumferentially about the center axis Lg on the front, right and left sides of the housing 102. The upper wall 111*b* is joined to the upper end of the circumferential wall 111*a*. The lower wall 111*c* is joined to the lower end of the circumferential wall 111*a*.

A plurality of slits 112 are formed in an upper part of the circumferential wall 111*a*. Air flows from the engine compartment R through the slits 112 into the guide space 113. The upper wall 111*b* is a part of a wall demarcating the outlet passage 91*c*.

The lower wall 111*c* is a flat plate fastened to the lower end of the cover 111 with screws.

Figure 13:
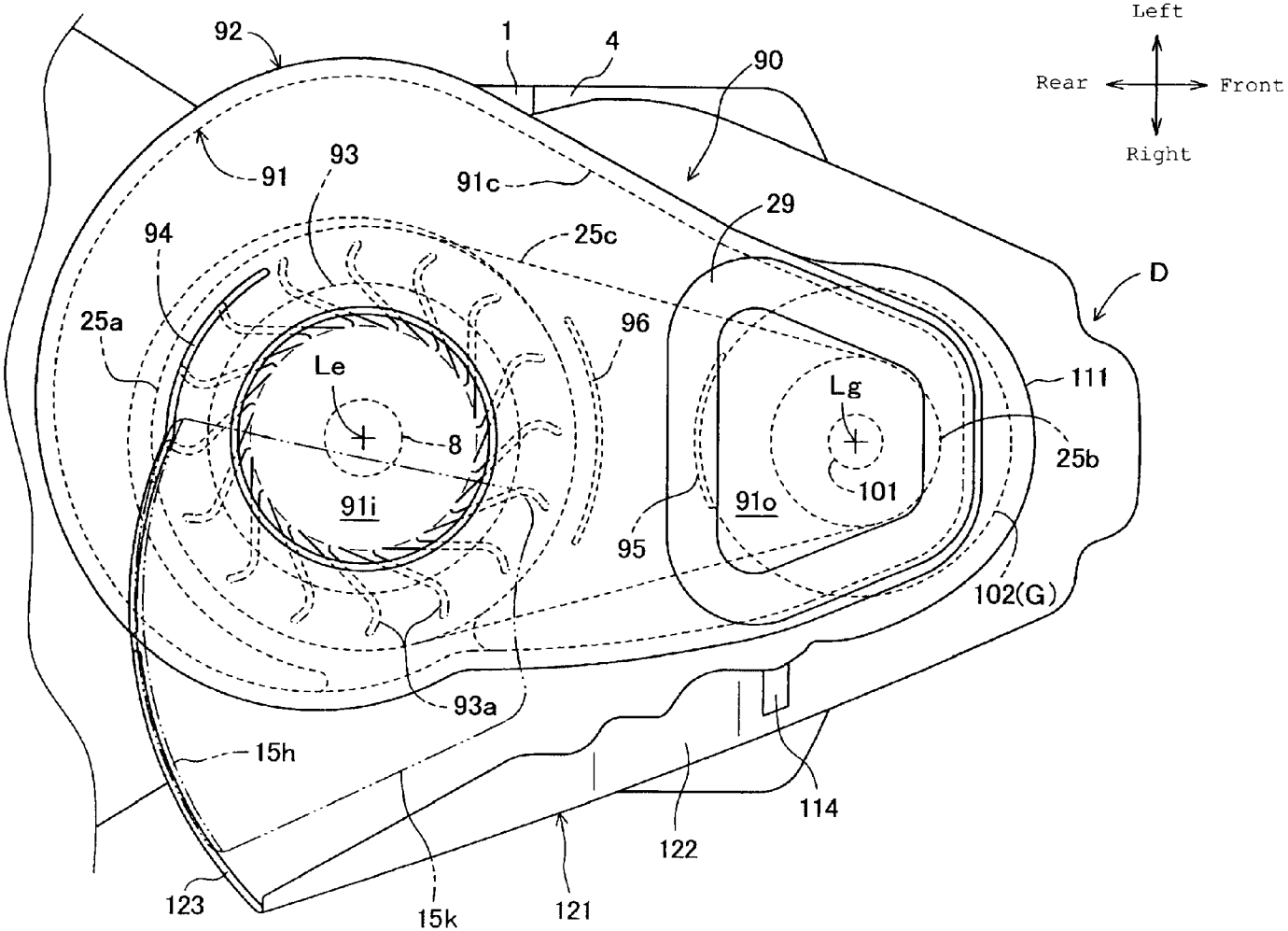
FIG. 13 is a top plan view of essential members forming the discharge passage and the air guide structure included in the outboard motor shown in FIG. 1.
Figure 14:
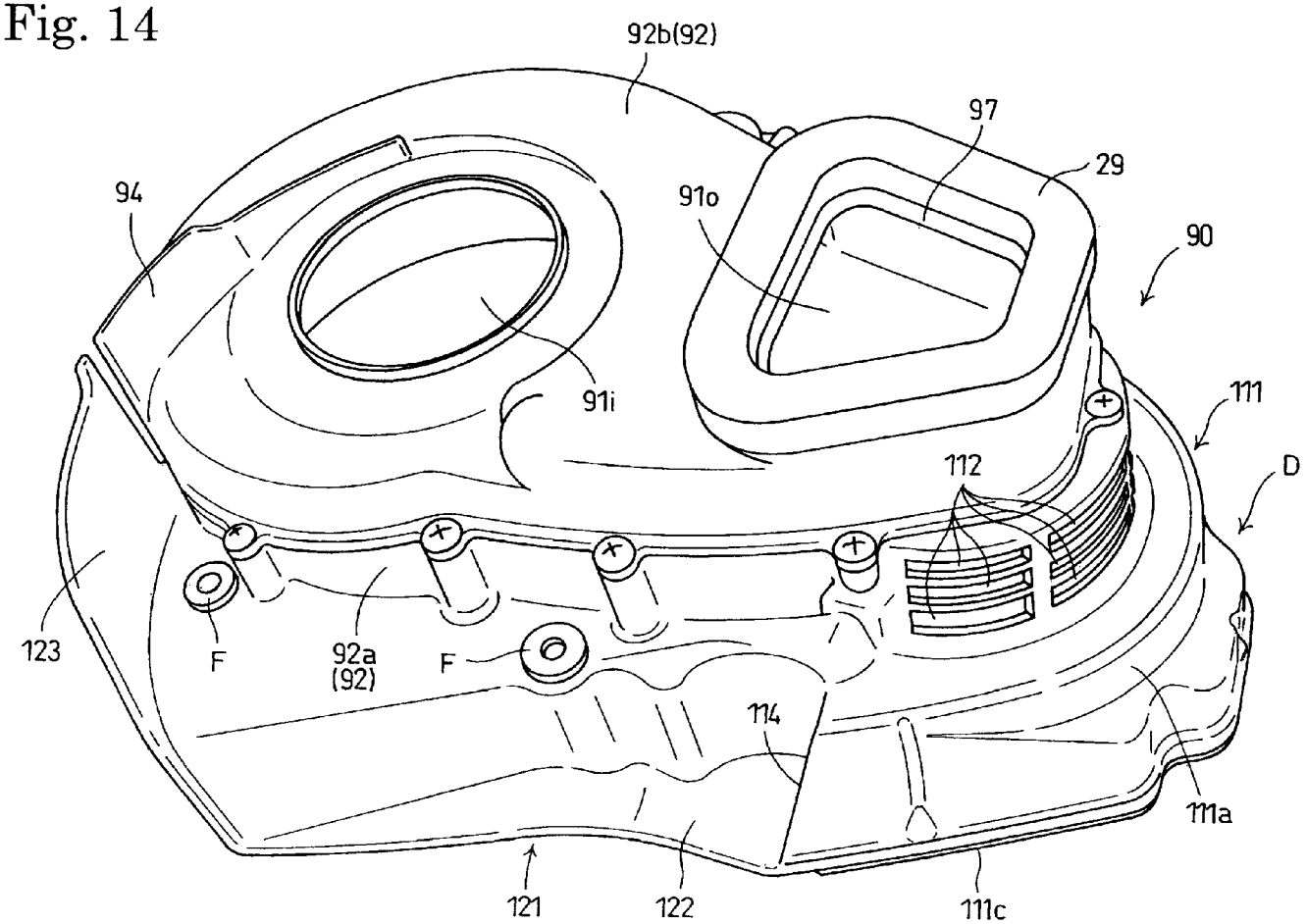
FIG. 14 is a perspective view of the members forming the discharge passage and the air guide structure included in the outboard motor shown in FIG. 1 taken from above those members.
Figure 15:
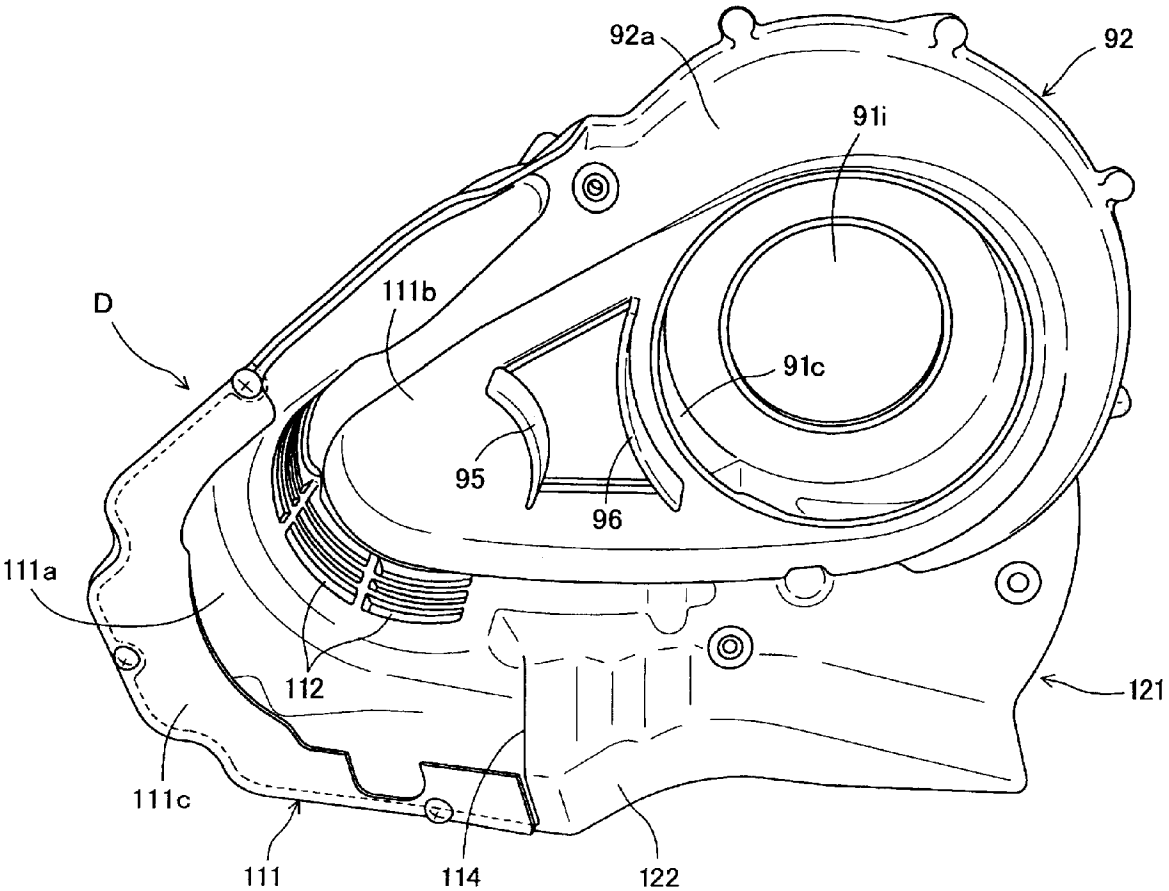
FIG. 15 is a perspective view of the members forming the discharge passage and the air guide structure included in the outboard motor shown in FIG. 1 taken from below those members.

Air flowing out through the outlet openings 104 is restrained from flowing upward from the guide space 113 by the upper wall 111*b*, is restrained from flowing downward from the guide space 113 by the lower wall 111*c* and is guided toward a discharge opening 114, which will be described later. As shown in FIGS. 9, 11 and 13, the upper wall 111*b* is provided with a pair of baffle walls 95 and 96. The baffle walls 95 and 96 prevent cooling air flowing through the slits 112 into the guide space 113 from being sucked into the fan 93 and prevent air from being directly sucked from the guide space 113 into the fan 93 instead of flowing through the discharge opening 114. Thus the upper wall 111*b*, the lower wall 111*c* and the baffle walls 95 and 96 ensure discharging air efficiently from the guide space 113 through the discharge opening 114.

Figure 16:
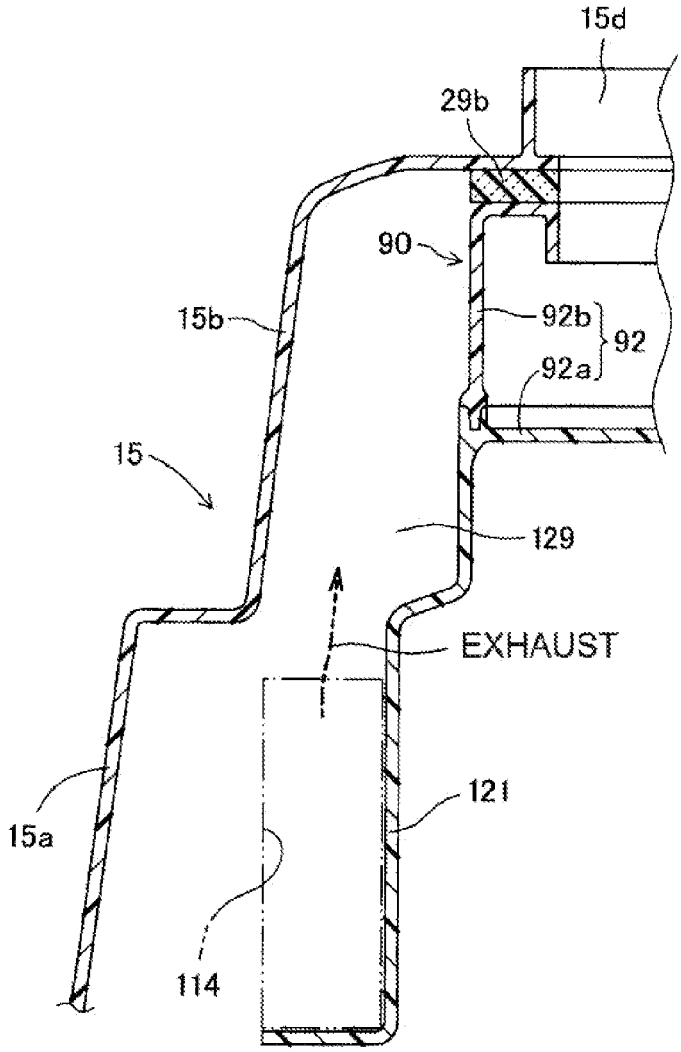
FIG. 16 is a sectional view taken on the line XVI-XVI in FIG. 9.

The discharge opening 114 is formed in a lower part of the circumferential wall 111*a* of the cover 111 at a position corresponding to the rear end of the alternator G on the right side of the alternator G. Referring also to FIG. 16, the discharge opening 114 is formed such that air is discharged from the annular guide space 113 tangentially thereto and clockwise as viewed in FIG. 3 through the discharge opening 114 into a guide passage 129 formed by the guide wall 121 and the engine cover 15 so as to flow rearward toward the inlet ventilation passage 91*i* disposed on the rear side of the alternator G.

The guide wall 121 has an inclined part 122 (FIG. 9) sloping upward to guide air discharged through the discharge opening 114 toward the inlet ventilation passage 91*i* at a level higher than that of the discharge opening 141, and a deflecting part 123 for deflecting air flowing through the guide passage 129 toward the inlet ventilation passage 91*i* and the center axis of the fan 93 aligned with the center axis Le. Air deflected by the deflecting part 123 is guided toward the inlet ventilation passage 91*i* by a vertical deflecting wall 94 (FIG. 2) formed integrally with the upper case 92*b*. The top wall 15*b* of the engine cover 15 is integrally provided with a deflecting wall 15*h* (FIGS. 3, 9 and 13) and a covering wall 15*k*. The deflecting wall 15*h* extends down opposite to the deflecting walls 13 and 94. The covering wall 15*k* covers the inlet ventilation passage 91*i* from above. In FIG. 13, the deflecting wall 15*h* is dislocated from the position corresponding to the deflecting walls 123 and 94 to facilitate understanding. The deflecting wall 15*h* guides efficiently air discharged through the discharge opening 114 toward the inlet ventilation passage 91*i* and prevents the air discharged through the discharge opening 114 from obstructing air to flow toward the inlet ventilation passage 91*i* in the engine compartment R. The covering wall 15*k*, namely, an upwardly protruding part of the top wall 15*b*, covers a major part on the side of the guide passage 129 of the sectional area of the inlet ventilation passage 91*i* in a plane (FIGS. 4 and 13), and a part on the side of the inlet ventilation passage 91*i* of the guide passage 129 from above.

The operation and effect of the outboard motor S in the preferred embodiment will be described.

In the outboard motor S, the intermediate cover 28 is disposed between the engine cover 15 and the top cover 27 with respect to the vertical direction, the first joining protrusions 15*e* and 28*e* for joining the engine cover 15 and the intermediate cover 28 together are disposed in the space between the top cover 15 and the intermediate cover 28, and the second joining protrusions 27*f* and 27*g* for joining the intermediate cover 28 and the top cover 27 together are disposed in the space between the top cover 27 and the intermediate cover 28. The engine cover 15 and the intermediate cover 28 are joined together by fastening the joining protrusion 15*e* and 28*e* in the space between the engine cover 15 and the intermediate cover 28. The top cover 27 and the intermediate cover 28 are joined together by fastening together the joining protrusions 27*f* and 28*f* in the space between the top cover 27 and the intermediate cover 28. Thus, the engine cover 15 and the top cover 27 are connected by the intermediate cover 28. Since the intermediate cover 28 is between the engine cover 15 and the top cover 27 with respect to the vertical direction, the space defined by the engine cover 15 and the top cover 27 is divided by the intermediate cover 28, the distance between the engine cover 15 and the intermediate cover 28 and the distance between the intermediate cover 28 and the top cover 27 are shorter than the distance between the engine cover 15 and the top cover 27. Therefore, the joining protrusions 15*e*, 28*e*, 27*f* and 28*f* are short. Therefore, the joining protrusions 15*e*, 28*e*, 27*f* and 28*f* can be easily formed in a necessary rigidity. The distance between the engine cover 15 and the top cover 27 places few restrictions on the arrangement of the joining protrusions 15*e*, 28*e*, 27*f* and 28*f*. Consequently, the degree of freedom of arranging the joining protrusions 15*e*, 28*e*, 27*f* and 28*f* is large. Thus, the joining protrusions 15*e*, 28*e*, 27*f* and 28*f* can be arranged in an optimum arrangement in case the top cover 27 is large, in case the air-intake space 40, the upstream intake passage 51, the inlet ventilation passage 71 and the outlet ventilation passage 81 are formed in the space between the engine cover 15 and the top cover 27, in case the engine cover 15 and the top cover 27 need to be highly rigid, and in case the load acting on the engine cover 15 when the grip 130 is gripped needs to be distributed.

The engine cover 15 does not need to be enlarged vertically to ensure the high rigidity of the joining protrusions connecting the engine cover 15 and the top cover 28. Any large mold is not necessary for forming the engine cover 15, and the engine cover 15 can be formed at reduced cost.

The intermediate cover 28 is provided with the ducts 55, 56, 76 and 85 respectively forming the upstream inlet passage 51*i*, the upstream outlet passage 51*o*, the outlet passage 71*o* and the inlet passage 81*i* connecting the interior and the exterior of the engine compartment R. The ducts 55 and 56 extend upward in the upstream intake passage 51, the duct 76 extends upward in the inlet ventilation passage 71 and the duct 85 extends upward in the outlet ventilation passage 81. Therefore the ducts 55, 56, 76 and 85 are capable of stopping water. The engine cover 15 has a simple shape as compared with a shape in which the engine cover 15 is formed with those ducts, and hence the engine cover can be manufactured at a reduced manufacturing cost.

The upstream expansion chamber 51*a* through which intake air for the internal combustion engine E flows is formed in the upstream intake passage 51 by the intermediate cover 28 and the top cover 27. The engine cover 15 has a simple shape as compared with a shape in which the engine cover 15 is used for forming the upstream expansion chamber 51*a*, and hence the engine cover 15 can be manufactured at a reduced manufacturing cost. Since the upstream expansion chamber 51*a* is spaced apart upward from the engine compartment R in which intake air is heated by the internal combustion engine E by a distance corresponding to the distance between the engine cover 15 and the intermediate cover 28 or the thickness of the air-intake space 40, heating of intake air in the upstream expansion chamber 51*a* by heat radiated from the internal combustion engine E can be suppressed. Consequently, the engine E can operate at increased volumetric efficiency.

Ventilation air flows through the inlet ventilation passage 71 into the engine compartment R to ventilate the engine compartment R. Since the inlet ventilation passage 71 is spaced apart from the engine compartment R in which intake air is heated by the engine E, by a distance corresponding to the distance between the engine cover 15 and the intermediate cover 28 or the thickness of the air-intake space 40, heating of ventilation air in the inlet ventilation passage 71 by heat radiated from the internal combustion engine E can be suppressed. Consequently, the engine E can be cooled effectively by ventilation air.

In the outboard motor S provided with the power unit P, the intake device 30 includes the downstream intake silencer 60 forming the downstream intake passage 61, which has the inlet passage 61*i* opening outside the engine compartment R. The ventilation system has the exit ventilation structure 90 forming the inner outlet ventilation space 91 having the outlet ventilation passage 91*o* opening into a space outside the engine compartment R. The downstream intake silencer 60 and the exit ventilation structure 90 are separate structures and are separate from the engine cover 15. Both the downstream intake silencer 60 and the exit ventilation structure 90 are disposed in the engine compartment R. Therefore, heat exchange between the intake air flowing through the intake passage including the downstream intake passage 61 and the ventilation air flowing through the inner outlet ventilation space 91 can be suppressed. Thus, the volumetric efficiency of the internal combustion engine E is high, there are few restrictions on the arrangement of the downstream intake silencer and the exit ventilation structure 90 in the engine compartment R, and the degree of freedom of arranging the downstream intake silencer 60 and the exit ventilation structure 90 is large. Therefore, the downstream intake silencer 60 and the exit ventilation structure 90 can be formed in optimum functional shapes, which is effective in improving intake efficiency and ventilation efficiency.

The ventilation air inlet opening Ri opening to the exterior of the engine compartment R is formed on the side of the cylinder heads 2 with respect to the center axis Le. The exit ventilation structure 90 is formed on the opposite side of the ventilation air inlet opening Ri with respect to the downstream intake silencer 60 and at a position near the center axis Le. Air flowing through the ventilation air inlet opening Ri near the cylinder heads 2 into the engine compartment R cools the cylinder heads 2 and the cylinder blocks 1 heated at comparatively high temperatures by combustion in the combustion chambers 22, and then flows into the inner outlet ventilation space 91 formed in the exit ventilation structure 90 disposed near the center axis Le. Thus, air of a comparatively high temperature in the engine compartment R can be discharged from the engine compartment R. Thus, ventilation air cools the internal combustion engine E efficiently and the engine compartment R can be efficiently ventilated.

Each overhead-camshaft valve train 23 is provided with the camshaft 23*a* rotationally driven by the crankshaft 8 through the camshaft driving mechanism 24. The downstream intake silencer 60 and the exit ventilation structure 90 are arranged longitudinally over the camshaft driving mechanism 24. Thus, the downstream intake silencer 60 and the exit ventilation structure 90 form the two-part belt cover structure. Therefore, the downstream inlet silencer 60 can be attached by moving it forward from the rear to dispose the same in place and can be detached by moving it rearward to remove the same, while the exit ventilation structure 90 can be attached by moving it rearward from the front to place the same in place and can be detached by moving it forward to remove the same. Thus, the belt cover structure including the downstream intake silencer 60 and the exit ventilation structure 90 can be easily installed in place.

The sealing member 140 clamped between the circumferential edge 15*m* of the top wall 15*b* and the downstream entrance duct 62 joined together to form the opening 15*c* and the downstream inlet passage 61*i* has the sealing lip 142 pressed closely against the joining surface J1 of the circumferential edge 15*m*, the flexible circumferential side part 144 that is bent or curved elastically when the lip 142 is pressed against the joining surface J1, and the inside surface 145 exposed to the connecting passage 141 and being subjected to the pressure of intake air. The inside surface 145 of the sealing member 140 has the sealing surface 145*a*. The sealing surface 145*a* faces the joining surface J1 in a direction in which a negative suction pressure acts in a state where the lip 142 is in close contact with the joining surface J1 and where the negative suction pressure is not acting on the inside surface 145. When the negative suction pressure acts on the sealing surface 145*a*, the lip 142 is pressed against the joining surface J1. Since the flexible circumferential side part 144 bends elastically when the lip 142 is thus depressed by the joining surface J1, the circumferential edge 15*m* and the downstream entrance duct 62 can be reliably connected by the sealing member 140, and the circumferential edge 15*m*, which is a part of the intermediate cover 28, and the downstream entrance duct 62 included in the downstream intake silencer 60 can be easily connected. Thus connecting work for connecting the circumferential edge 15*m* and the downstream entrance duct 62 is facilitated. The negative suction pressure acting on the sealing surface 145*a* presses the lip 142 against the joining surface J1. Thus, the sealing effect of the lip 142 can be enhanced by the negative suction pressure in the connecting passage 141.

The sealing surface 145*a* and the joining surface J1 forms the space 141*a* continuous with the connecting passage 141 before the negative suction pressure acts on the circumferential side surface 145*a*. Since the negative suction pressure acting on the circumferential side surface 145*a* presses the lip 142 against the joining surface J1, the negative suction pressure of intake air flowing through the connecting passage 141 enhances the sealing effect of the lip 142. The space 141*a* formed when the flexible circumferential side part 144 bends increases the area of the sealing surface 145*a*.

The sealing member 140 is provided with the hollow 146, the lip 142 is flexible, and the flexible circumferential side part 144 has the thin wall 144*a* capable of being easily bent. The sealing part of the lip 142 comes into close contact with the joining surface J1. Therefore, the sealing part can deform easily, which facilitates the connecting work. Since the hollow 146 in the sealing member 140 forms the thin wall 144*a* of the flexible circumferential side part 144, the flexible circumferential part 144 can be easily formed. When the flexible circumferential side part 144 is bent, the volume of the hollow 146 is reduced. Consequently, the lip 142 is pressed firmly against the joining surface J1 by the pressure of the gas filling up the hollow 146 to enhance the sealing effect of the sealing member 140.

The outboard motor S includes the engine cover 15 forming the engine compartment R holding the internal combustion engine E provided with the intake system 30 for carrying intake air to the combustion chambers 22 formed in the engine body, the intermediate cover 28 covering the engine cover 15 from above, the top cover 27 covering the intermediate cover from above, and the upstream intake silencer 50 through which intake air for combustion taken in through the air-intake opening 42 flows to the intake system 30. The upstream intake silencer 50 is disposed outside the engine compartment R and is spaced apart from the engine cover 15 so that the air-intake space 40 having the air-intake opening 42 is formed. The upstream intake silencer 50 has the upstream entrance duct 55 forming the upstream inlet passage 51*i* into which intake air flows from the air-intake space 40 and spaced apart from the engine cover 15, the structure 57 forming the upstream expansion chamber 51*a* into which intake air flows through the upstream inlet passage 51*i*, and the upstream exit duct 56 forming the upstream outlet passage 51*o* through which intake air flows into the intake system 30. The upstream end 51*i*1 of the upstream inlet passage 51*i* opens into the air-intake space 40. The air-intake opening 42 is at a level lower than that of the upstream end 51*i*1 of the upstream inlet passage 51*i*. The air-intake opening 42 extends on the rear, right and left sides of the upstream intake silencer 50 or the upstream expansion chamber 51*a* in a plane.

The upstream intake silencer 50 disposed outside the engine compartment R attenuates intake pulsation propagating from the intake system 30. Since the upstream intake silencer 50 is separated upward from the engine cover 15 by the air-intake space 40, the transmission of intake pulsation from the intake system 30 to the air-intake space 40 is suppressed, so that noise resulting from the vibration of the engine cover 15 forming the air-intake space 40 is reduced.

Since the air-intake opening 42 extends on the rear, right and left sides of the upstream intake silencer 50 or the upstream expansion chamber 51*a* in a plane, the air-intake space has an increased length. Therefore, the air-intake opening 42 can be formed in the small width W while the air-intake opening 42 ensures taking external air in at a necessary intake rate. Since the air-intake opening 42 has the small width W, the high effect of the air-intake opening 42 on suppressing the entrance of water and foreign maters into the air-intake space 40 can be ensured.

Since the air-intake opening 42 is at a level lower than that of the upstream inlet passage 51*i*, and the upstream entrance duct 55 is spaced apart from the engine cover 15 and does not extend upward from the engine cover 15, the upstream entrance duct 55 places few restrictions on designing the shape of the top wall 15*b* demarcating the air-intake space 40 of the top cover 15 and hence the degree of freedom of designing the top wall 15*b* is large.

Since the downstream end 51*o*2 of the upstream outlet passage 51*o* are on the rear side of the upstream end 51*i*1 of the upstream inlet passage 51*i* in the air-intake space 40, it is difficult for water that has entered the air-intake space 40 from the rear to flow through the upstream end 51*i*1 into the upstream inlet passage 51*i*. Thus, water is restrained from flowing into the upstream intake silencer 50.

The structure 57 included in the upstream intake silencer 50 has the lower wall 53 separated from the engine cover 15 by the air-intake space 40, and the upstream entrance duct 55 does not extend downward from the lower wall 53 and extends upward from the lower wall 53 into the upstream expansion chamber 51*a*. Therefore, water is restrained from flowing through the upstream inlet passage 51*i* into the upstream intake silencer 50. Since the upstream entrance duct 55 extends upward into the upstream expansion chamber 51*a*, the upstream intake silencer 50 can be disposed vertically close to the engine cover 15 and hence the outboard motor S can be formed in reduced vertical size.

Since the upstream entrance duct 55 does not extend downward from the lower wall 53, a part around the upstream inlet passage 51*i* of the lower wall 53 can be placed close to the engine cover 15. Thus, the upstream expansion chamber 51*a* can be formed in an enlarged volume without disposing the upstream intake silencer 50 at a high level relative to the engine cover 15. Consequently, the outboard motor S can be formed in reduced vertical size, and the upstream expansion chamber 51*a* of a large volume enhances the intake noise reducing effect of the upstream intake silencer 50.

The engine cover 15 has the right side wall 15*t* and the left side wall 15*s* facing the right and the left side part, respectively, of the air-intake opening 42. The air-intake space 40 has the right rising space 40*t* defined by the intermediate cover 28 and the right side wall 15*t*, and the left rising space 40*s* defined by the intermediate wall 28 and the left side wall 15*s*. The right rising space 40*t* and the left rising space 40*s* extend upward from the air-intake opening 42. The right rising space 40*t* extends between the right side part of the air-intake opening 42 and the upstream inlet passage 51*i*, and the left rising space 40*s* extends between the left side part of the air-intake opening 42 and the upstream inlet passage 51*i*. Respective upper parts of the rising spaces 40*t* and 40*s* connect to the upper part 40*i* of the air-intake space 40 into which the upstream inlet passage 51*i* opens. Therefore, water flowing through the air-intake opening 42 into the air-intake space 40 impinges on and adheres to the side walls 15*t* and 15*s*, and hence the amount of water that rises in the rising spaces 40*t* and 40*s* is limited. Thus, water is prevented from entering the upstream intake silencer 50.

The right and left side parts of the air-intake opening 42 on the right and left sides of the upstream end 51*i*1 and the downstream end 51*o*2 of the upstream outlet passage 51*o* extend longitudinally beyond the front and rear ends of the longitudinal range Y in which the upstream end 51*i*1 and the downstream end 51*o*2 are arranged. Thus, the air-intake opening 42 extending around the lower end of the air-intake space 40 can be formed in an increased length. Therefore, even though the air-intake opening 42 is formed in the small width W, and the entrance of water and foreign matters into the air-intake space 40 can be prevented.

The upstream end 51*i*1 of the upstream inlet passage 51*i*, and the downstream end 51*o*2 of the upstream outlet passage 51*o* are spaced part from each other with respect to the longitudinal direction and are on the front and left sides, respectively, of the center axis Le. Therefore, the air-intake opening 42 can be formed in an increased length and the small width W, so that water and foreign matters can be prevented from entering the air-intake space 40.

The outboard motor S includes the engine cover 15 forming the engine compartment R holding the internal combustion engine E provided with the intake system 30 for carrying intake air into the combustion chambers 22 formed in the engine body, the intermediate cover 28 covering the engine cover 15 from above, and the top cover 27 covering the intermediate cover 28 from above. The engine cover 15, the top cover 27 and the intermediate cover 28 define the air-intake space 40 opening into the air-intake opening 42. The upstream ends 51*i*1 and 61*i*1 through which air flows from the air-intake space 40, and downstream ends 51*o*2 and 61*o*2 through which intake air flows from the upstream ends 51*i*1 and 61*i*1 into the intake system 30 disposed in the engine compartment R are formed in the air-intake space 40. The upstream intake silencer 50 is disposed in the air-intake space 40. The air-intake opening 42 is extended on the right and left sides of the upstream end 51*i*1 in a longitudinal range from a position corresponding to the cylinder heads 2 and the valve covers 3 to a position on the front side of the center axis Le.

Since the upstream intake silencer 50 is interposed between the intake system 30 disposed in the engine compartment R and the air-intake space 40, intake pulsation transmitted from the intake system 30 to the air-intake space 40 is attenuated and noise resulting from the vibration of the engine cover 15 defining the air-intake space 40 is reduced.

The right and left side parts of the air-intake opening 42 extend longitudinally on the right and left sides of the upstream end 51*i*1 in a longitudinal range from a position corresponding to the cylinder heads 2 and the valve covers 3 to the position on the front side of the center axis Le. Therefore, the air-intake opening 42 can be formed in increased length and the small width W and a necessary intake rate can be ensured, the effect of the air-intake opening 42 on suppressing the entrance of water and foreign maters into the upstream intake silencer 50 can be enhanced, and the entrance of water and foreign matters into the upstream intake silencer 50 can be effectively prevented, and the flow of water together with intake air through the upstream end 51*i*1 into the upstream intake silencer 50 can be effectively prevented.

The air-intake opening 42 opens rearward at the rear end of the air-intake space 40, and the respective downstream ends 51*i*2 and 61*i*2 of the inlet passages 51*i* and 61*i* are disposed on the rear side of the upstream ends 51*i*1 and 61*i*1, respectively. Since the upstream ends 51*i*1 and 61*i*1 are on the front side of the downstream ends 51*i*2 and 61*i*2 in the air-intake space 40, it is difficult for water that has passed into the air-intake space 40 to flow through the upstream ends 51*i*1 and 61*i*1 into the inlet passages 51*i* and 61*i*, and hence the entrance of water into the upstream intake silencer 50 is prevented.

Water that has flowed into the air-intake space 40 is drained in lateral directions from the air-intake space 40. Therefore, the flow of water through the inlet passages 51*i* and 61*i* into the intake silencers 50 and 60 together with intake air can be effectively suppressed.

The top cover 15 has the protruding part 15*p* protruding upward into the air-intake space 40 at the same lateral position as the upstream end 51*i*1 between the air-intake opening 42 and the upstream inlet end 51*i*1 with respect to the longitudinal direction. The protruding part 15*p* prevents the water that has entered the air-intake space 40 from the rear through the air-intake opening 42 from reaching the upstream end 51*i*1 of the upstream inlet passage 51*i*. Thus the flow of water into the upstream intake silencer 50 is prevented.

The upstream end 51*i*1 and the downstream end 51*o*2 of the outlet passage 51*o* are longitudinally spaced apart from each other and are disposed on the front and rear sides, respectively, of the center axis Le of the crankshaft 8, and the air-intake opening 42 extends longitudinally on the right and left sides of the upstream end 51*i*1 and the downstream end 51*o*2 of the upstream outlet passage 51*o* beyond the opposite longitudinal ends of the range Y in which the upstream end 51*i*1 and the downstream end 51*o*2 are arranged. Therefore, the air-intake opening 42 can be formed in an increased length and hence the air-intake opening can be formed in the small width W to prevent the entrance of water and foreign maters into the air-intake space 40.

The outboard motor S includes the internal combustion engine E provided with the intake system 30 for carrying intake air to the combustion chambers 22 formed in the engine body, the engine cover 15 forming the engine compartment R holding the internal combustion engine E, the intermediate cover 28 covering the engine cover 15 from above, and the top cover 27 covering the intermediate cover from above. The engine cover 15, the top cover 27 and the intermediate cover 28 form the air-intake space 40 having the air-intake opening 42 through which intake air is taken in. The outboard motor S is provided with the upstream intake silencer 50 through which intake air for combustion taken in through the air-intake opening 42 flows to the intake system 30 disposed inside the engine compartment R. The upstream intake silencer 50 is disposed outside the engine compartment R. The intake system 30 includes the downstream intake silencer 60 into which intake air flows from the upstream intake silencer 50, and the throttle device 31 into which intake air flows from the downstream intake silencer 60. The upstream intake silencer 50 is provided with an upstream inlet passage 51*i* opening into the air-intake space 40 to receive intake air from the air-intake space 40, the upstream outlet passage 51*o* through which intake air flows from the upstream intake silencer 50 into the downstream intake silencer 60 The downstream intake silencer 60 is provided with the downstream inlet passage 61*i* connected to the upstream outlet passage 51*o*, and the downstream outlet passage 61*o* through which intake air flows from the downstream intake silencer 60 into the throttle passage 33 of the throttle device 31. The upstream inlet passage 51*i* is on the front side of the upstream outlet passage 51*o*. The downstream outlet passage 61*o* is on the opposite side of the upstream inlet passage 51*i* with respect to the upstream outlet passage 51*o* and the downstream inlet passage 61*i*.

The intake system 30 disposed in the engine compartment R includes the downstream intake silencer 60, and the upstream intake silencer 50, through which intake air flows into the downstream intake silencer 60, is disposed outside the engine compartment R. Intake pulsation transmitted from the intake system 30 is attenuated by the upstream intake silencer 50 and hence intake noise is reduced.

The upstream inlet passage 51*i* of the upstream intake silencer 50 opening into the air-intake space 40 formed outside the engine compartment R is on the front side of the upstream outlet passage 51*o*. Therefore, when the air-intake opening 42 opens rearward at the rear end of the air-intake space 40, the upstream inlet passage 51*i* is a large longitudinal distance apart from the air-intake opening 42, and hence water that has flowed into the air-intake space 40 is prevented from flowing into the upstream intake silencer 50. Thus, the flow of water together with intake air into the upstream intake silencer 50 can be effectively prevented.

The downstream outlet passage 61*o* is on the longitudinally opposite side of the upstream inlet passage 51*i* with respect to the upstream outlet passage 51*o* and the downstream inlet passage 61*i*. Therefore, intake air flows smoothly from the upstream inlet passage 51*i* through the upstream outlet passage 51*o* and the downstream inlet passage 61*i* into the downstream outlet passage 61*o*, and resistance to the flow of intake air is low. Consequently, volumetric efficiency is high and the internal combustion engine E can achieve high output performance.

The upstream outlet passage 51*o*, the downstream inlet passage 61*i* and the downstream outlet passage 61*o* are arranged across the straight line La crossing the upstream inlet passage 51*i* and the throttle passage 33 in a plane. The upstream inlet passage 51*i*, the upstream outlet passage 51*o*, the downstream inlet passage 61*i*, the downstream outlet passage 61*o* and the throttle passage 33 are on a straight line in a plane. Therefore, the flow of intake air from the upstream inlet passage 51*i*, the upstream outlet passage 51*o* and the downstream inlet passage 61*i* into the downstream outlet passage 61*o*, i.e., the flow of intake air through the upstream intake silencer 50 and the downstream intake silencer 60, does not meander laterally. Consequently, intake resistance is low and the internal combustion engine E can operate at high volumetric efficiency.

The throttle passage 33 extends longitudinally along the straight line La in a plane. Therefore, resistance exerted by the passage through the upstream intake silencer 50 and the downstream intake silencer 60 to the throttle device 31 on the flow of intake air is low, and hence the internal combustion engine E operates at high volumetric efficiency.

The upstream intake silencer 50 is separated from the engine cover 15 by the air-intake space 40. Therefore, the transmission of intake pulsation from the intake system 30 to the air-intake space 40 is suppressed, and noise resulting from the vibration of the engine cover 15 forming the air-intake space 40 is reduced.

In the outboard motor S provided with the internal combustion engine E having the combustion chambers 22, the upper upstream intake silencer 50 into which intake air flows and the lower downstream intake silencer 60 through which intake air flows into the combustion chambers 22 are put one on top of the other. The upstream intake silencer 50 above the downstream intake silencer 60 has the upstream inlet passage 51*i*, the upstream expansion chamber 51*a* and the upstream outlet passage 51*o*. The downstream intake silencer 60 has the downstream inlet passage 61*i* connected to the upstream outlet passage 51*o*, the downstream expansion chamber 61*a*, and the downstream outlet passage 61*o*. The lower wall 53 of the upstream expansion chamber 51*a* is a stepped wall having the raised part 53*a* overlapping the downstream intake silencer 60 in a plane, and the lowered part 53*b* separated from the downstream intake silencer 60 in a plane and at a level lower than that of the raised part 53*a*. The upstream outlet passage 51*o* is formed in the raised part 53*a* of the lower wall 53. The upstream outlet passage 51*o* is formed in the raised part 53*a*.

Since the lowered part 53*b* of the stepped lower wall 53 of the upstream intake silencer 50 does not overlap the downstream intake silencer 60, the lowered part 53*b* can be extended downward. Therefore, the upper expansion chamber 51*a* can be formed in an increased volume and hence the upstream intake silencer 50 is given a high intake noise reducing effect.

The raised part 53*a* provided with the upstream outlet passage 51*o* connected to the downstream inlet passage 61*i* of the downstream intake silencer 60 is extended immediately above the downstream intake silencer 60 and the downstream intake silencer 60 is disposed in the space underlying the raised part 53*a*. Therefore, the upstream outlet passage 51*o* and the downstream inlet passage 61*i* is connected and the upstream intake silencer 50 and the downstream intake silencer 60 can be disposed vertically close to each other by using the raised part 53*a* of the lower wall 53. Thus the upstream intake silencer 50 and the downstream intake silencer 60 can be compactly superposed, which is effective in forming the outboard motor S in reduced vertical size.

The upper wall 67 of the downstream intake silencer 60 is a stepped wall having the raised part 67*a*, and the lowered part 67*b* overlapping the lower wall 53 of the upstream expansion chamber 51*a* in a plane and extending at a level lower than that of the raised part 67*a*. The downstream inlet passage 61*i* is formed in the lowered part 67*b*. The raised part 67*a* of the stepped upper wall 67 of the downstream intake silencer 60 is at a level higher than that of the lowered part 67*b*. Therefore, the downstream expansion chamber 61*a* can be formed in a large volume and hence the downstream intake silencer 60 is given a high intake noise reducing effect.

The lowered part 67*b* of the stepped upper wall 67, provided with the downstream inlet passage 61*i* connecting to the upstream outlet passage 51*o* of the upstream intake silencer, is disposed directly below the upstream intake silencer 50. The upstream intake silencer 50 is placed in a space extending over the lowered part 67*b* of the upper wall 67. Therefore, the upstream outlet passage 51*o* and the downstream inlet passage 61*i* is connected and the upstream intake silencer 50 and the downstream intake silencer 60 can be disposed vertically close to each other by using the lowered part 67*b* of the upper wall 67. Thus, the upstream intake silencer 50 and the downstream intake silencer 60 can be compactly superposed, which is effective in forming the outboard motor S in reduced vertical size.

The downstream inlet passage 61*i* is formed in the lowered part 67*b* of the upper wall 67 of the downstream intake silencer 60. The lowered wall 53 of the upstream intake silencer 50 and the upper wall 67 of the downstream intake silencer 60 are formed in the stepped shapes complementary to each other. The lowered part 53*b* of the lower wall 53 of the upstream intake silencer 50 does not overlap the downstream intake silencer 60 in a plane. The raised part 67*a* of the upper wall 67 of the downstream intake silencer 60 is at a level higher than that of the lowered part 67*b*. Therefore, the expansion chambers 51*a* and 61*a* can be formed in large volumes, respectively, and hence the intake silencers 50 and 60 are given an increased intake noise reducing effect.

The lowered part 67*b* provided with the downstream inlet passage 61*i* of the upper wall 67 is disposed directly below the first raised part 53*a*1 provided with the upstream outlet passage 51*o*, and the lowered part 67*b* at a level lower than that of the raised part 67*a* underlies the first raised part 53*a*1. Therefore, the upstream outlet passage 51*o* and the downstream inlet passage 61*i* is connected and the upstream intake silencer 50 and the downstream intake silencer 60 can be disposed vertically close to each other by using the first raised part 53*a*1 of the upstream intake silencer 50 and the lowered part 67*b* of the downstream intake silencer overlapping each other in a plane. Thus the upstream intake silencer 50 and the downstream intake silencer 60 can be compactly superposed, which is effective in forming the outboard motor S in reduced vertical size.

The upstream intake silencer 50 and the downstream intake silencer 60 are on the upper side and on the lower side, respectively, of the top wall 15*b* of the engine cover 15. The upstream intake silencer 50 is disposed in the air-intake space 40 formed outside the engine compartment R by the engine cover 15 and the top cover 27 covering the engine cover 15. The downstream intake silencer 60 is disposed inside the engine compartment R. Therefore, the engine cover 15 and the outboard motor S can be formed in small sizes. Therefore, the vibration of the engine cover 15 caused by intake pulsation attenuated by the intake silencers 50 and 60 can be effectively suppressed and hence noise resulting from the vibration of the engine cover 15 caused by intake pulsation can be reduced.

The ventilation system forming the outer outlet ventilation space 81 for ventilating the engine compartment R includes the case 92 disposed in the engine compartment R, and the fan 93 placed in the inner outlet ventilation space 91 connecting to the outer outlet ventilation space 81 to ventilate the engine compartment R. The inner outlet ventilation space 91 has the inlet ventilation passage 91*i* formed in the upper space Ra in the engine compartment R and opening upward. Thus, the inlet passage 91*i* of the inner outlet ventilation space 91 in which the fan 93 for discharging air from the engine compartment R of the outboard motor S through the outer outlet ventilation space 81 outside the engine compartment R is formed in the upper space Ra in the engine compartment R and opens upward. Therefore, the fan can efficiently suck high-temperature air that has cooled the internal combustion engine E from the upper space Ra, in which high-temperature air collects, in the engine compartment R and can efficiently discharge high-temperature air to the outside of the engine compartment R, i.e., outside the outboard motor S. Consequently, the engine compartment R can be ventilated at high efficiency, the internal combustion engine E can be effectively cooled by the ventilation air, and temperature rise in the engine compartment R can be effectively suppressed.

The alternator G and the air guide structure D forming the guide passage 129 are disposed in the engine compartment R. High-temperature air that has worked for cooling the alternator G flows through the guide passage 129 formed by the air guide structure D into the inlet ventilation passage 91*i* in which the fan 93 is disposed. Thus, the diffusion of ventilation high temperature air in the engine compartment R is prevented, ventilation air can be efficiently sucked into the fan 93, the internal combustion engine E can be effectively cooled, and temperature rise in the engine compartment R can be effectively suppressed.

The inner outlet ventilation space 91 formed in the engine compartment R and the outer outlet ventilation space 81 formed outside the engine compartment R are at the same longitudinal position near the alternator G. Therefore, the inner outlet ventilation space 91 can be formed in a narrow range Y and hence the engine cover 15 may be small, which is effective in forming the outboard motor S in small size.

The ventilation system having the outer outlet ventilation space 81 formed outside the engine compartment R has the fan 93 placed in the inner outlet ventilation space 91 for delivering air by pressure from the engine compartment R to the outer outlet ventilation space 91, and the air guide structure D for delivering cooling air that has worked for cooling the alternator G through the outer outlet ventilation space 81 to the inlet ventilation passage 91*i* of the inner outlet ventilation space 91. The fan 93 for discharging air from the engine compartment R of the outboard motor S to the outside of the engine compartment R is placed in the outer outlet ventilation space 91 connecting to the upstream end of the outer outlet ventilation space 81, and the alternator G is surrounded by the air guide structure D for guiding high-temperature cooling air that has worked for cooling the alternator G disposed in the engine compartment R to the inlet ventilation passage 91*i* of the inner outlet ventilation space 91 surrounds. Therefore, the diffusion of the cooling air that has worked for cooling the alternator G in the engine compartment R is prevented, the fan can suck the cooling air efficiently, the alternator G can be effectively cooled by ventilation air, and temperature rise in the engine compartment R can be effectively suppressed.

The air guide structure D has the cover 111 surrounding the housing 102 of the alternator G, and a guide wall forming the guide passage 129 for guiding air discharged from the guide space 113 formed by the guide cover 111 and the housing 102 to the inlet ventilation passage 91*i*. The guide passage 129 is formed by the combination of the guide wall 121 and the engine cover 15. Thus, the guide passage 129 for guiding the air discharged into the guide space 113 formed by the guide cover 111 of the air guide structure D to the inlet ventilation passage 91*i* of the inner outlet ventilation space 91 is formed by the combination of the guide wall 121 of the air guide structure D, and the engine cover 15. Since the engine cover 15 is used for forming the guide passage 129 for guiding the discharged air to the fan 93, the air guide structure D having the guide wall 121 is a small, lightweight structure, the engine cover 15 is small and the outboard motor S can be formed in small size.

Since the inlet ventilation passage 91*i* is formed in the upper space Ra and opens upward, the fan 93 can efficiently suck the high-temperature air which has worked for cooling the internal combustion engine E and which collected in the upper space Ra and can efficiently discharge the high-temperature air to the outside from the engine compartment R, i.e., from the outboard motor S. Thus, the engine compartment R can be efficiently ventilated, and ventilation air can effectively coo the internal combustion engine E and can effectively suppress temperature rise in the engine compartment R.

The guide space 113 is formed by the guide cover 111 and has the discharge opening 114 through which air is discharged into the engine compartment R toward the inner outlet ventilation space 91. The inlet ventilation passage 91*i* is disposed above the discharge opening 114. The guide wall 121 has the inclined part 122 sloping upward to guide air discharged through the discharge opening 114 toward the inlet ventilation passage 91*i*. Therefore, air discharged from the alternator G flows through the discharge opening 114 of the guide cover 111 toward the inlet ventilation passage 91*i* of the inner outlet ventilation space 91 in which the fan 93 is placed. Since the inclined part 122 of the guide wall 121 deflects the flow of air toward the inlet ventilation passage 91*i* at a level higher than that of the discharge opening 114, the discharged ventilation air flowing through the guide passage 129 defined by the combination of the engine cover 15 and the guide wall 121 entrains high-temperature air heated in the engine compartment R and rising in the engine compartment R toward the inlet ventilation passage 91*i*. Consequently, the discharged ventilation air and the high-temperature air in the engine compartment R are sucked efficiently by the fan 93. Thus, the ventilation air can effectively cool the alternator G and can effectively suppress temperature rise in the engine compartment R.

The fan 93 is mounted on the crankshaft 8 of the internal combustion engine E. The outlet passage 81*o* opening into the atmosphere of the outer outlet ventilation space 81 is on the front side of the center axis Le of the crankshaft 8. Since the outlet passage 81*o*, through which the air discharged from the engine compartment R by the fan 93 placed in the inner outlet ventilation space 91 flows into the atmosphere, is on the front side of the center axis Le, the outlet passage 81*o* will not be stopped up with air waves propagating forward, and hence air from the engine compartment R can be efficiently discharged from the outboard motor S.

The ventilation system includes the fan 93, and the case 92 forming the inner outlet ventilation space 91. The air guide structure D and the exit ventilation structure 90 are united. Thus, the fan 93, the exit ventilation structure 90 including the case 92 forming the inner outlet ventilation space 91, and the air guide structure D for guiding the air discharged from the alternator G to the inlet ventilation passage 91*i* of the inner outlet ventilation space 91 are united together. Thus, the alternator G, the fan 93 and inlet ventilation passage 91*i* can be disposed close to each other. Therefore, diffusion of discharged air in the engine compartment R can be efficiently prevented, and the air guide structure D and the exit ventilation structure 90 for guiding the discharged air to the fan 93 can be formed in small, lightweight structures.

Parts of outboard motors in modifications different from the corresponding parts of the above-described outboard motor in the preferred embodiment will be described, in which like or corresponding parts are designated by the same terms or the same reference characters when necessary.

Figure 17:
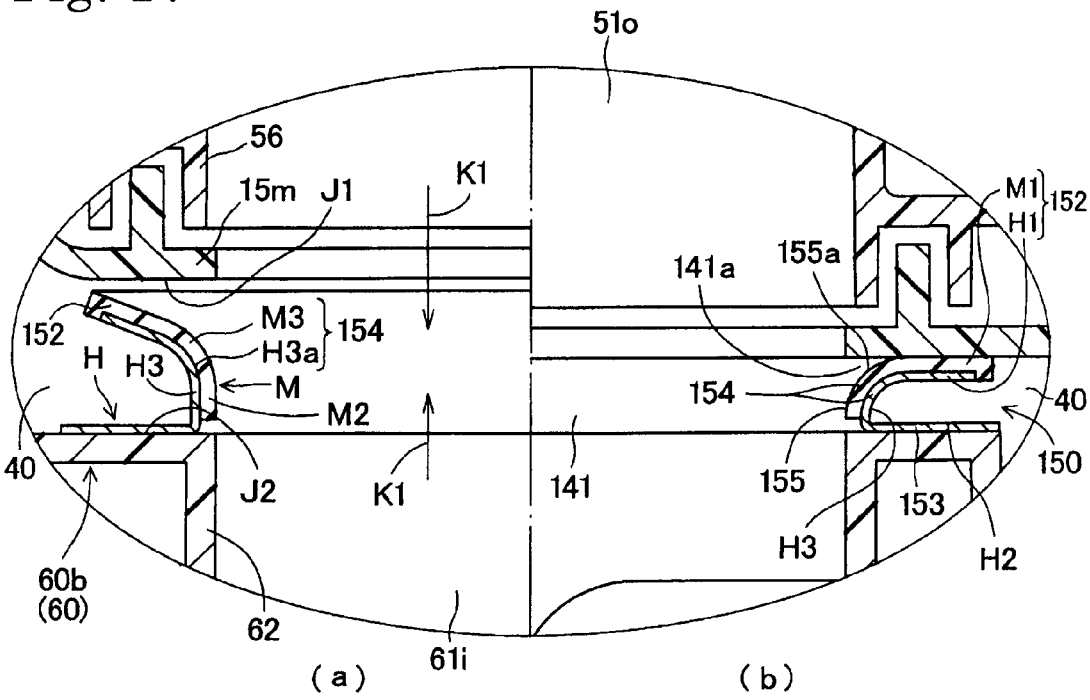
FIG. 17 is a sectional view, similar to FIG. 10, of a part around a sealing member of an outboard motor in a first modification of the outboard motor shown in FIG. 1.

As shown in FIG. 17, the outboard motor S may be provided with a sealing member 150 instead of the sealing member 140.

The sealing member 150 has a sealing part 152, a base part 153, a flexible part 154 and a working surface 155. The sealing member 150 has an annular body M made of rubber, and an elastic, annular backing H attached to the body M by baking or the like to hold the body M. The backing H is made by processing a spring sheet. The backing H has a U-shaped cross section opening radially outward to form an air-intake space 40. The backing H has a flat first annular part H1, a flat second annular part H2, and a cylindrical part H3 connecting the first annular part H1 and the second annular part H2 and having a curved part H3*a*.

The sealing part 152 includes an annular part M1 to be brought into close contact with the joining surface J1 of the circumferential edge 15*m*, and the first annular part H1. The base part 153 includes the second annular part H2. The second annular part H2 is closely attached to the joining surface J2 of the entrance duct 62 with an adhesive or the like. The flexible part 154 bends elastically when the sealing part 152 is depressed by the joining surface J1. The flexible part 154 includes a bending part M3 having the curved part H3*a* of the body M. Negative suction air pressure acts on the working surface 155 exposed to the connecting passage 141. The working surface 155 includes the inner surfaces of the cylindrical part M2 and the bending part M3.

FIG. 17 shows in the right side (b) a state in which negative pressure is not acting on the working surface 155, the sealing member 150 is squeezed between the circumferential edge 15*m* and the entrance duct 62 and the sealing part 152 is in close contact with the joining surface J1. In this state, the working surface 155 has an inner surface 155*a* facing the joining surface J1 in the direction of action of the negative suction air pressure and a space 141*a* is formed between the joining surface J1 and the inner surface 155*a* as indicated in (b) of FIG. 17.

Negative suction air pressure acts on the inner surface 155*a* in a direction perpendicular to the inner surface 155*a* to press the sealing part 152 against the joining surface J1. The negative suction air pressure is applied to the sealing part 152 in addition to the resilience of the backing H of the sealing member 150 to enhance the sealing pressure working on the sealing part 152 accordingly.

The work and effect of the sealing member 150 is the same as those of the sealing member 140 excluding the work and effect of the hollow 146 of the sealing member 140.

Figure 18:
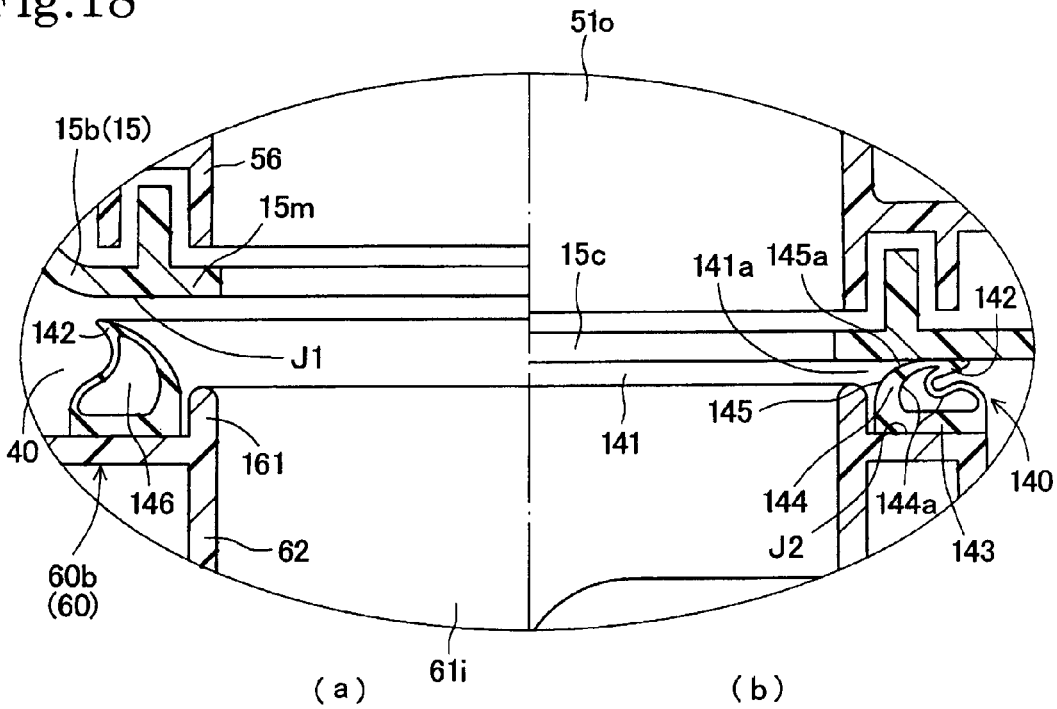
FIG. 18 is a sectional view, similar to FIG. 10, of a part around a sealing member combined with a deformation restricting member of an outboard motor in a second modification of the outboard motor shown in FIG. 1.
Figure 19:
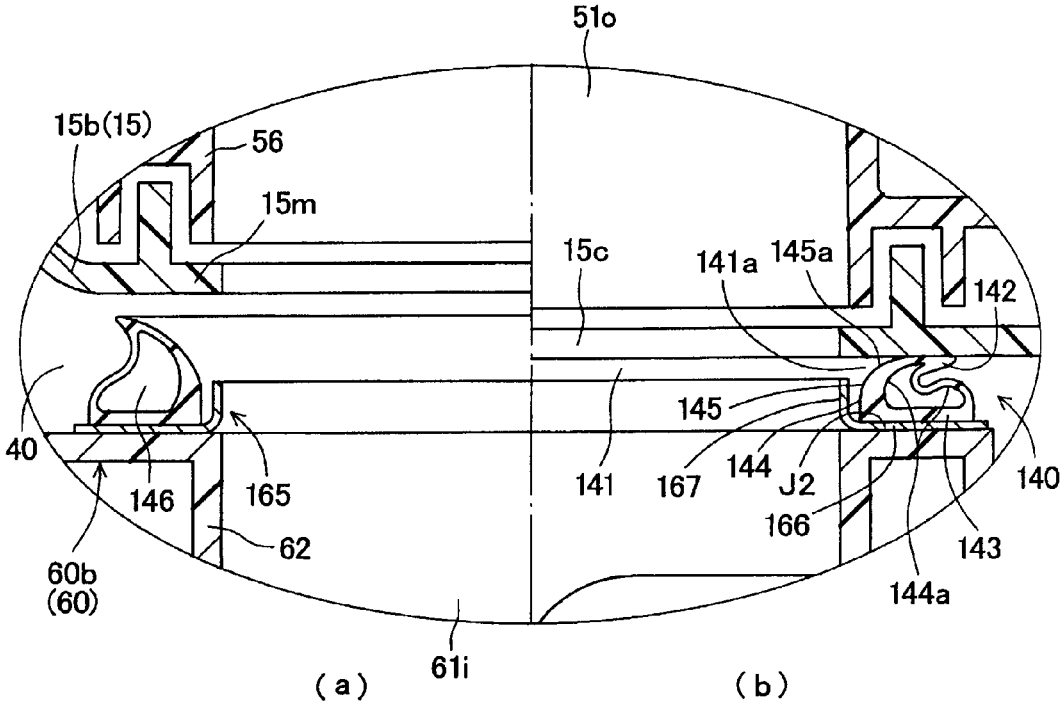
FIG. 19 is a sectional view, similar to FIG. 10, of a part around a sealing member combined with a deformation restricting member of an outboard motor in a third modification of the outboard motor shown in FIG. 1.

As shown in FIGS. 18 and 19, respective deformation restricting members 161 and 165 for preventing the excessive deformation of the sealing member 140 by the negative suction air pressure may be provided on the inner side of the working surface 145. In FIG. 18, the deformation restricting member 161 is an annular projection formed integrally with the entrance duct 62 and rising from the joining surface J2 toward the lip 142 of the sealing member 140. In FIG. 19, the deformation restricting member 165 is an annular member made of a metal and separate from the entrance duct 62. The deformation restricting member 165 has a base part 166 firmly fixed to the base 143 by baking and bonded to the joining surface J2 with an adhesive, and an annular deformation restricting part 167 rising toward the joining surface J1 from the inner circumference of the base part 166.

The deformation restricting member 161 (165) comes into contact with the sealing member 140 to prevent excessive deformation of the sealing member 140. When the sealing member 140 is deformed so as to protrude into the connecting passage 141 by the negative suction air pressure, the sealing member 140 comes into contact with the deformation restricting member 165 (deformation restricting part 167). Thus, the excessive deformation of the sealing member 140 is prevented by the deformation restricting member 165 (deformation restricting part 167) and, consequently, the deterioration of the sealing effect of the sealing member 140 resulting from the excessive deformation of the sealing member 140 can be prevented.

Figure 20:
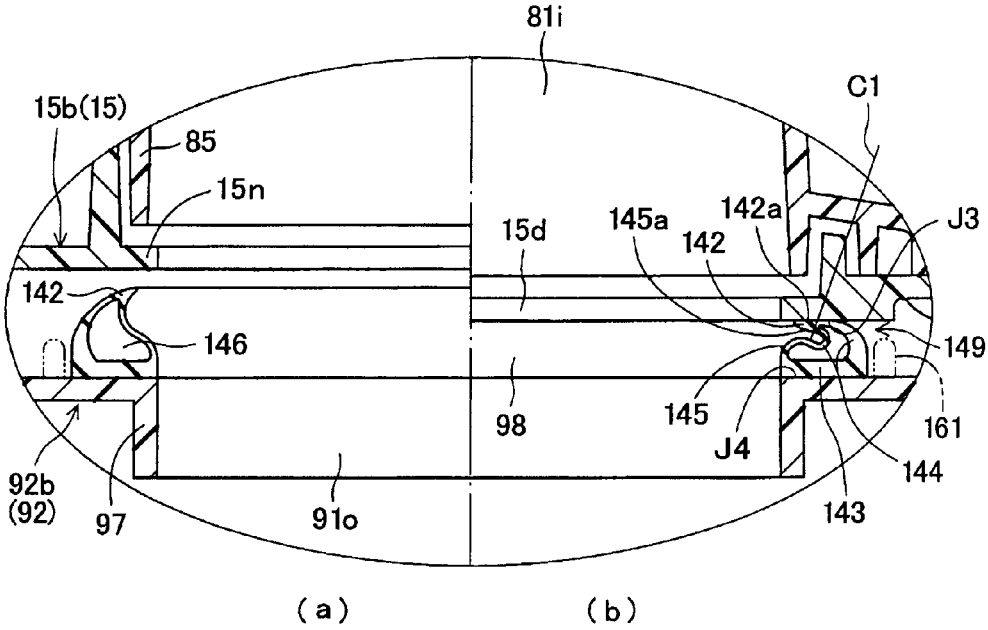
FIG. 20 is a sectional view of a part around a sealing member of an outboard motor in a fourth modification of the outboard motor shown in FIG. 1, in which (a) shows the sealing member in a free state and (b) shows the sealing member in a working state.
Figure 21:
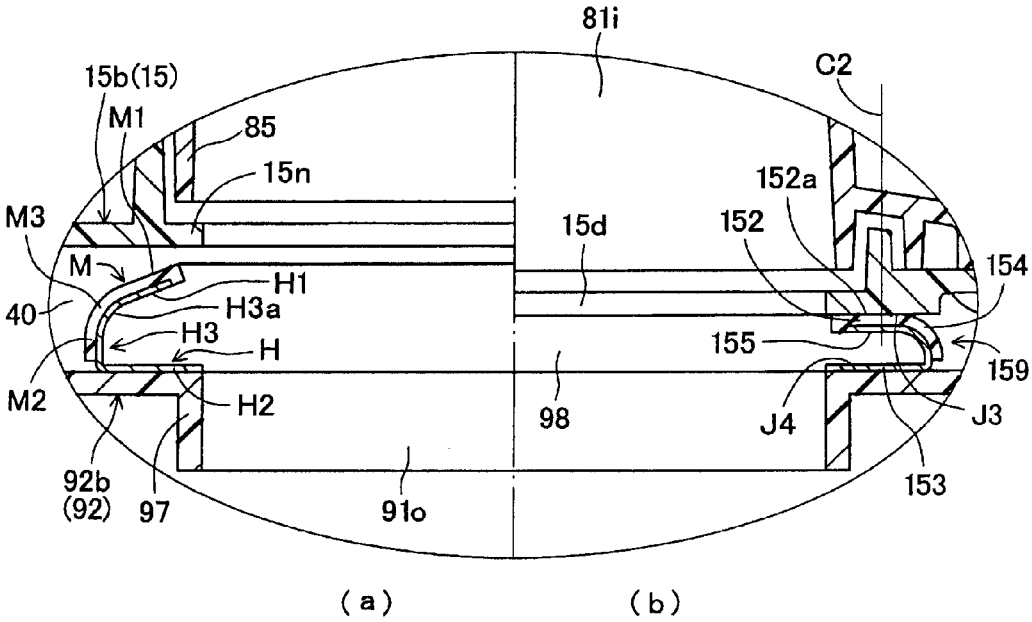
FIG. 21 is a sectional view, similar to FIG. 20, of a part around a sealing member of an outboard motor in a fifth modification of the outboard motor shown in FIG. 1.

As shown in FIGS. 20 and 21, respective sealing members 149 and 159 similar to the sealing member 140 (150) may be used. In this case, the gas that flows through the passage 98 is ventilation air discharged from the engine compartment R. Since the ventilation air is blown by the ventilation fan 93 (FIG. 2) under pressure, the pressure of the ventilation air, namely, ventilation pressure, is a positive pressure. The lip 142 of the sealing member 149 has the shape of a flange extending obliquely toward the passage 98 as shown in (a) of FIG. 20 before the lip 142 is depressed by the joining surface J3. The lip 142 bends toward the passage 98 when squeezed between the joining surfaces J3 and J4. The elastic backing H of the sealing member 159 has a U-shaped cross section opening radially inward, away from the air-intake space 40.

In a state before the ventilation pressure acts on the working surface 145 (155) of the sealing member 149 (159), a contact surface 142*a* (152*a*) of the lip 142 (the sealing part 152) that comes into contact with the joining surface J3, and an inner surface 145*a* (155*a*) are on the line C1 (C2) of action of the ventilation pressure shown in FIG. 20(*b*) (FIG. 21(*b*)). Therefore, the positive ventilation pressure acting on the inner surface 145*a* (155*a*) presses the lip 142 (the sealing part 152) against the joining surface J3 to enhance the sealing pressure of the lip 142 (the sealing part 152).

In a state before the ventilation pressure of ventilation air discharged from the engine compartment R acts on the working surface 145, the contact surface 142*a* (152*a*) of the lip 142 (the sealing part 152) and the inner surface 145*a* (155*a*) are on the line of action of the ventilation pressure on the inner surface 145*a* (155*a*). Therefore, the ventilation pressure of ventilation air flowing through the connecting passage 98 acting on the inner surface 145*a* (155*a*) presses the lip 142 (the sealing part 152) against the joining surface J3 to enhance the sealing pressure of the lip 142 (the sealing part 152), so that the sealing effect of the sealing member 149 (159) is improved. Since the contact surface 142*a* (152*a*) of the bent lip 142 (the bent sealing part 152) and the inner surface 145*a* (155*a*) are on the line of action of the ventilation pressure, ventilation pressure presses the lip 142 (the sealing part 152) effectively against the joining surface J3 to improve the sealing effect of the sealing members 149 (159).

As indicated by two-dot chain lines in FIG. 20, the exit duct 97 may be integrally provided around the sealing member 149 with a deformation restricting member 161 for restricting excessive deformation of the sealing member 149. A deformation restricting member similar to the deformation restricting member 165 shown in FIG. 19 may be provided such that its deformation restricting part surrounds the sealing member 149.

The outboard motor may be provided with a plurality of intermediate members instead of one. The plurality of intermediate members may be arranged such that adjacent ones of the intermediate members are vertically spaced apart from each other. The intermediate member may not be such a cover as the intermediate cover 28. For example, the intermediate member may be in the form of a frame or bars.

The fastening means for fastening together the connecting parts 15*e* and 28*e*, and the connecting parts 27*f* and 28*f* are not limited to screws N1 and N2. The fastening means may be those other than the screws N1 and N2, such as bolts and nuts or an adhesive.

Either of the connecting parts 15*a* and the connecting parts 28*e* or either of the connecting parts 27*f* and the connecting parts 28*f* are not necessarily the protrusions but may be flat parts or recessed parts. The connecting parts 15*e* and the engine cover 15, the connecting parts 28*e* or 28*f* and the intermediate cover 28, and the connecting parts 27*f* and the top cover 27 may be separate members, respectively.

One of the passage forming members may be the entrance duct 62 or the exit duct 97.

Although the top cover 27 forms part of the intake silencer 50 in the foregoing embodiment, a member other than the top cover 27 may be used for forming part of the intake silencer 50.

The air-intake opening 42 may be formed at least on either of the right and left sides of the upstream inlet ends 51*i*1 and 61*i*1. The rear end of the air-intake space 40 may be closed and disconnected from the air-intake opening 42. If the rear end of the air-intake space 40 is so formed, intake air is taken into the air-intake space 40 through the air-intake opening 42 longitudinally extending on the right and left sides or on either of the right and left sides of the inlet and the outlet.

The internal combustion engine may be a V-type internal combustion engine other than the V-type six-cylinder internal combustion engine, an in-line multiple-cylinder internal combustion engine or a single-cylinder internal combustion engine.

What is claimed is:

1. An outboard motor comprising:

An internal combustion engine;

an engine cover forming an engine compartment for holding the internal combustion engine therein, and a top cover covering the engine cover from above, the top cover being connected to the engine cover and provided with a carrying grip to be used for carrying the top cover, the outboard motor further comprising:

an intermediate cover placed in a space between the engine cover and the top cover;

first connecting parts arranged in a space between the engine cover and the intermediate cover to connect the engine cover and the intermediate cover; and second connecting parts arranged in a space between the top cover and the intermediate cover to connect the top cover and the intermediate cover, wherein said intermediate cover has air ducts forming part of an air passage extending between a space outside the engine compartment and an engine inlet passage for intake air to be sucked into the engine, and said air passage including an intake silencer for conducting intake air to be sucked into the engine, the intake silencer having therein an intake passage formed between the intermediate cover and the top cover, said air ducts projecting upward into the intake passage, one of the air ducts being an entrance duct for conducting air into the intake passage and the other of the air ducts being an exit duct for conducting air out of the intake passage.

2. The outboard motor according to claim 1, wherein the intermediate cover has an additional air duct forming part of an air passage extending between a space outside the engine compartment and a space inside the engine compartment, and the additional air duct includes a passage for conducting ventilation air for ventilating the engine compartment into the engine compartment, the additional air duct being formed by the intermediate cover and the top cover.

3. The outboard motor according to claim 1, wherein the engine is provided with an intake system for carrying intake air into a combustion chamber of the engine, the intake system being disposed in the engine compartment, an outer covering structure including the top cover covers the engine cover from above, the engine cover and the outer covering structure form an air-intake space having an air-intake opening through which external air flows into the air-intake space, the intake silencer is formed in the air-intake space, the intake silencer having an upstream inlet end through which intake air flows from the air-intake space into the intake silencer and a downstream outlet end through which intake air flows from the intake silencer into the intake system, and the air-intake opening extends at least on either of opposing right and left sides, with respect to a longitudinal center line of the outboard motor, of the upstream inlet end in a longitudinal range between a position corresponding to rear end members of the engine and a position on a front side of a center axis of a crankshaft included in the engine.

4. The outboard motor according to claim 3, wherein the air-intake opening opens rearward at a rear end of the air-intake space, and the downstream outlet end is on a rear side of the upstream inlet end.

5. The outboard motor according to claim 4, wherein the engine cover is provided with a protruding part protruding into the air-intake space at the same lateral position as the upstream inlet end between the air-intake opening and the upstream inlet end with respect to a longitudinal direction.

6. The outboard motor according to claim 3, wherein the upstream inlet end and the downstream outlet end are spaced apart from each other with respect to the longitudinal direction and are disposed on a front side and on a rear side, respectively, of the center axis of the crankshaft, and the longitudinal range extends beyond opposite longitudinal ends of a range in which the upstream inlet end and the downstream outlet end are arranged.

7. The outboard motor according to claim 1, wherein the engine includes a cylinder head for defining a combustion chamber, a crankcase, a crankshaft disposed in the crankcase, and an intake system forming an intake passage through which intake air for combustion flows into the combustion chamber, a ventilation system is disposed in the engine compartment, the ventilation system having an outlet ventilation space through which air in the engine compartment is discharged to an outside of the engine compartment, the intake system is provided with an intake passage forming structure forming the intake passage including an air inlet passage opening outside the engine compartment, the ventilation system is provided with an exit ventilation structure forming the outlet ventilation space having an outlet ventilation passage opening to an outside of the engine compartment, the intake passage forming structure, the exit ventilation structure and the engine cover are formed separately, and the intake passage forming structure and the exit ventilation structure are disposed in the engine compartment.

8. The outboard motor according to claim 7, wherein a ventilation air inlet opening outside the engine compartment is formed in the engine cover, the ventilation air inlet opening is disposed near the cylinder head with respect to the center axis of the crankshaft as viewed in a direction parallel to the center axis of the crankshaft with respect to a direction in which the ventilation air inlet opening and the outlet ventilation passage are arranged, and the exit ventilation structure is disposed near the center axis on the opposite side of the ventilation air inlet opening with respect to the intake passage forming structure.

9. The outboard motor according to claim 7, wherein the engine is provided with a valve train including a camshaft rotationally driven by the crankshaft transmitted thereto by a valve train driving mechanism, and the intake passage forming structure and the exit ventilation structure are arranged longitudinally and form a transmission cover longitudinally divided into two parts and covering the valve train driving mechanism from above.

10. The outboard motor according to claim 1, wherein the outboard motor includes a first passage forming member and a second passage forming member joined together with a sealing member therebetween, the first passage forming member and the second passage forming member form a connecting passage extending between a space outside the engine compartment and a space inside the engine compartment, the sealing member has a sealing part in close contact with a joining surface of the first passage forming member, a flexible part which is bent elastically when the sealing part is pressed by the joining surface, and a working surface exposed to the connecting passage and receiving pressure of a gas flowing through the connecting passage, the working surface has an inner surface facing the joining surface in a direction in which the pressure acts in a state in which the sealing part is in close contact with the joining surface before the pressure acts on the working surface, and the sealing part is pressed against the joining surface when the pressure acts on the inner surface.

11. The outboard motor according to claim 10, wherein the gas is intake air for combustion to be supplied to the engine, the pressure is negative suction air pressure, and a space connecting to the connecting passage is formed between the joining surface and the inner surface in a direction in which the negative suction air pressure acts on the inner surface before the negative suction air pressure acts on the working surface.

12. The outboard motor according to claim 10, wherein the gas is ventilation air discharged from the engine compartment, the pressure is a positive ventilation pressure, the contact surface of the sealing part that comes into contact with the joining surface and the inner surface are on a line of action of the ventilation pressure on the inner surface before the ventilation pressure acts on the working surface.

13. The outboard motor according to claim 10, wherein the sealing member has a hollow, the sealing part is a flexible lip having a shape of a flange, and the flexible part is provided with the hollow to form a bendable thin wall.

14. The outboard motor according to claim 10 further comprising a deformation restricting member, with which the deformed sealing member comes into contact, for preventing the sealing member from being excessively deformed by the pressure.

* * * * *